US005395715A

United States Patent [19]

Ueda et al.

[11] Patent Number: 5,395,715

[45] Date of Patent: Mar. 7, 1995

[54] PHOTOSENSITIVE MEMBER HAVING PHOTOSENSITIVE LAYER WHICH COMPRISES AMINO COMPOUND AS CHARGE TRANSPORTING MATERIAL

[75] Inventors: Hideaki Ueda, Kishiwada; Shigeaki Tokutake, Takatsuki; Keiichi Inagaki, Itami; Yuki Shimada, Suita, all of Japan

[73] Assignee: Minolta Camera Kabushiki Kaisha, Osaka, Japan

[21] Appl. No.: 83,264

[22] Filed: Jun. 29, 1993

[30] Foreign Application Priority Data

| | | | |
|---|---|---|---|
| Jul. 3, 1992 | [JP] | Japan | 4-176745 |
| Sep. 1, 1992 | [JP] | Japan | 4-233476 |
| Sep. 25, 1992 | [JP] | Japan | 4-256338 |

[51] Int. Cl.[6] ..... G03G 5/047

[52] U.S. Cl. ..... 430/59; 430/79; 430/73

[58] Field of Search ..... 430/58, 59, 73, 76, 430/79

[56] References Cited

U.S. PATENT DOCUMENTS

| | | | |
|---|---|---|---|
| 3,615,396 | 10/1971 | Gramza et al. | 96/1.6 |
| 4,273,846 | 6/1981 | Pai et al. | 430/59 |
| 4,297,425 | 10/1981 | Pai et al. | 430/58 |
| 4,835,081 | 5/1989 | Ong et al. | 430/59 |
| 4,869,988 | 9/1989 | Ong et al. | 430/59 |
| 4,877,702 | 10/1989 | Miyamoto et al. | 430/72 |
| 4,920,022 | 4/1990 | Sakakibara et al. | 430/59 |
| 5,059,503 | 10/1991 | Muto et al. | 430/83 |
| 5,149,609 | 9/1992 | Yu et al. | 430/58 |

*Primary Examiner*—John Goodrow

*Attorney, Agent, or Firm*—Burns, Doane, Swecker & Mathis

[57] ABSTRACT

The present invention relates to an improvement of a photosensitive member having a photosensitive layer which contains a specific amino compound as a charge transporting material.

9 Claims, 1 Drawing Sheet

PHOTOSENSITIVE MEMBER HAVING PHOTOSENSITIVE LAYER WHICH COMPRISES AMINO COMPOUND AS CHARGE TRANSPORTING MATERIAL

BACKGROUND OF THE INVENTION

The present invention relates to photosensitive member for electrophotography, and more particularly to an electrophotographic photosensitive member having a photosensitive layer which comprises an amino compound as a charge transporting material.

Widely known as photosensitive members for electrophotography are those of function-divided types comprising a charge generating layer and a charge transporting layer which are formed on an electrically conductive substrate, and those of dispersion types comprising a photoconductive layer formed on a substrate and prepared by dispersing photoconductive particles in resin.

With the function-divided type, separated layers work dividedly to serve the basic functions of the photosensitive member, i.e. generation of charge carriers and transport of the charges, to provide a photosensitive layer chargeable to a high surface potential and exhibiting great charge retentivity, high photosensitivity and stabilized repetition characteristics. Many compounds are known as charge generating materials and as charge transporting materials fox use in the photosensitive members of the function-divided type. For example, various organic photoconductors of low molecular weight have been proposed for use in charge transporting layers. More specifically, U.S. Pat. No. 3,189,447 proposes use of 2,5-bis(p-diethylaminophenyl)-1,3,4-oxadiazole, but this compound has only a poor compatibility with binders and is liable to separate out as crystals. Further U.S. Pat. No. 3,820,989 discloses use of diarylalkane derivatives having a high compatibility with binders. However, the photosensitive member containing the derivatives undergose variations in sensitivity when repeatedly used, and is still required to be improved in initial sensitivity and residual potential characteristics, as well as in sensitivity variations and durability for repeated use.

SUMMARY OF THE INVENTION

The main objects of the present invention are to improve the foregoing drawbacks of the prior arts and to provide an electrophotographic photosensitive member having a high photosensitivity and stable electrophotographic characteristics even at repeated use.

DETAILED DESCRIPTION OF THE INVENTION

Figure 1:
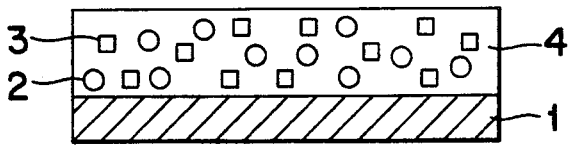
FIG. 1 is a schematic sectional view of a dispersion-type photosensitive member having a photosensitive layer on an electrically substrate.

The present invention relates to a photosensitive member having a photosensitive layer which comprises an amino compound as a charge transporting material represented by the following general formula [I ]:

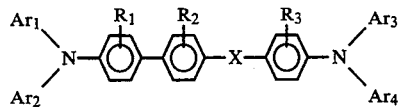

[I]

in which $Ar_1$, $Ar_2$, $Ar_3$, $Ar_4$ represent respectively an alkyl group such as methyl and ethyl, an aralkyl group such as benzyl and phenethyl, an aryl group such as phenyl, naphthyl, tolyl and biphenyl or a heterocyclic group such as a residue of thiophene, furan, pyridine, thiazole and dithiophene. $Ar_1$, $Ar_2$, $Ar_3$ and $Ar_4$ may have a substituent exemplified by an alkyl group such as methyl, an alkoxy group such as methoxy, a halogen atom such as chlorine atom and bromine atom, an hydroxyl group and a phenoxy group. A biphenyl group having an alkyl group is preferable. More preferably, $Ar_1$ and $Ar_3$ are respectively a biphenyl group, because sensitivity is improved effectively. $Ar_1$ and $Ar_2$, and/or $Ar_3$ and $Ar_4$ may form a ring in combination as represented by the following formula below:

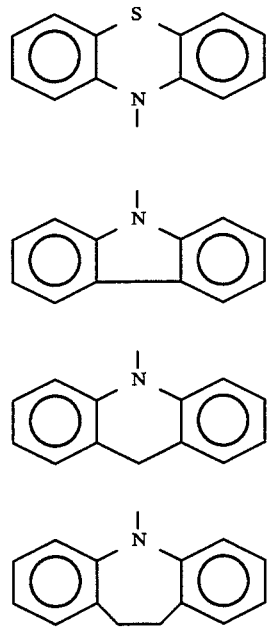

$R_1$, $R_2$ and $R_3$ represent respectively a hydrogen atom, an alkyl group such as methyl and ethyl, an alkoxy group such as methoxy and ethoxy or a halogen atom such as chlorine atom and bromine atom.

X represent—O—, —S—, —N($R_4$)— or —($R_5$)C($R_6$)—.

$R_4$ represents an alkyl group such as methyl, ethyl, propyl and buthyl, an aralkyl group such as benzyl and phenethyl, an aryl group such as phenyl, tolyl and xylyl, a biphenyl group or a heterocyclic group such as thienyl, thienylmethyl and a residue of dioxaindane. $R_4$ may have a substituent exemplified by an alkyl group such as methyl and ethyl, an alkoxy group such as methoxy and ethoxy, a phenoxy group and a halogen atom such as chlorine atom and bromine atom. Preferable $R_4$ is a phenyl group and a biphenyl group.

$R_5$ and $R_6$ represent respectively a hydrogen atom, an alkyl group such as methyl, ethyl and propyl or an aryl group such as phenyl and tolyl.

Concrete compounds having the amino structure represented by general formula [I ] are exemplified as shown below:

[1]

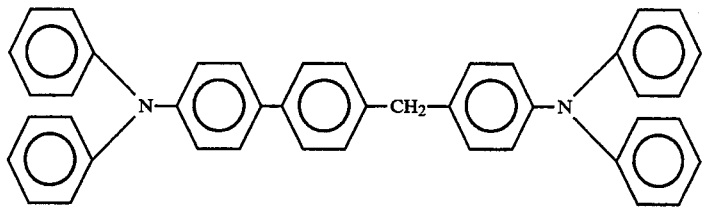

[2]

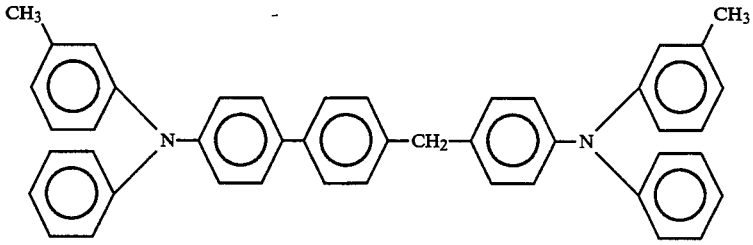

[3]

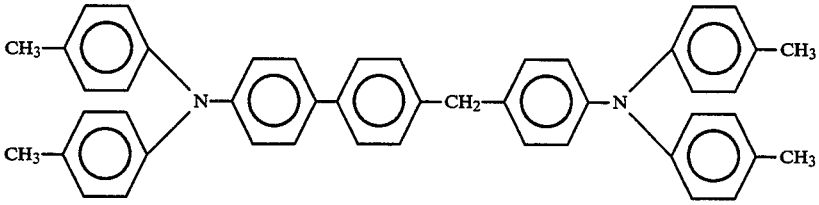

[4]

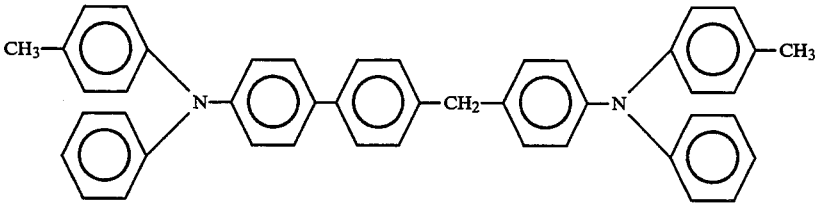

[5]

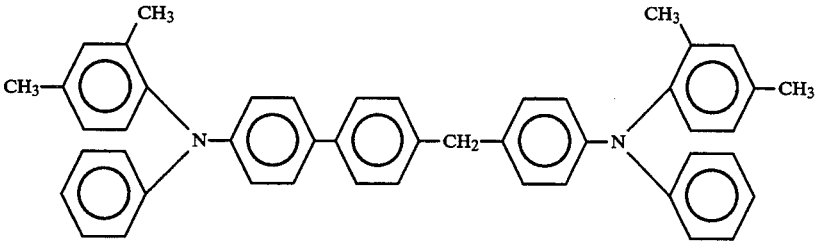

[6]

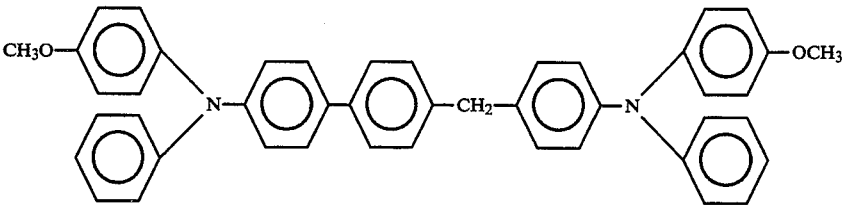

-continued
[7]
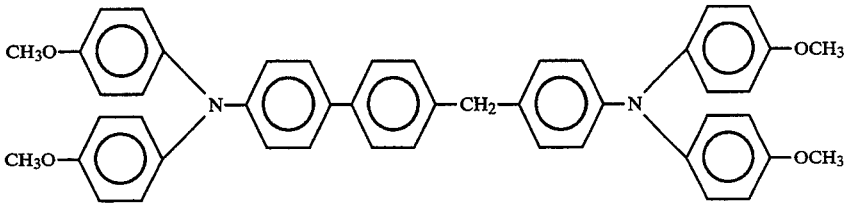
[8]
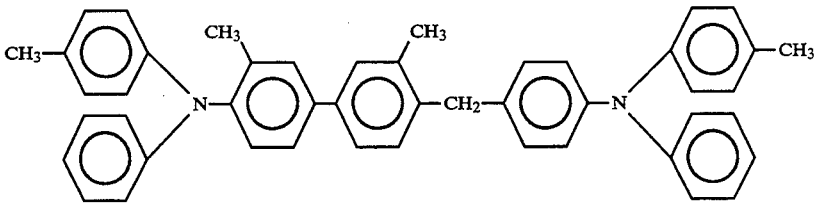
[9]
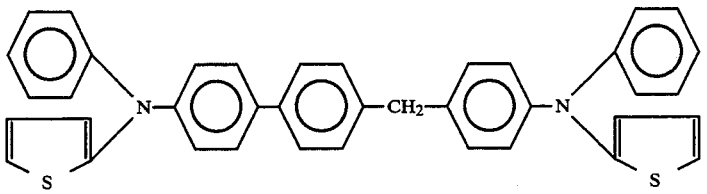
[10]
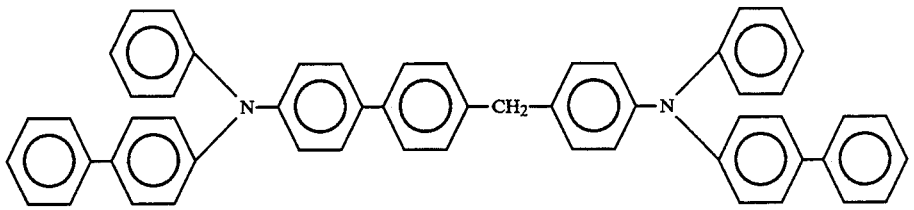
[11]
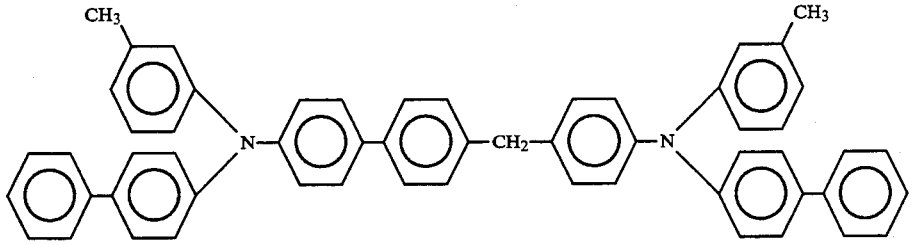
[12]
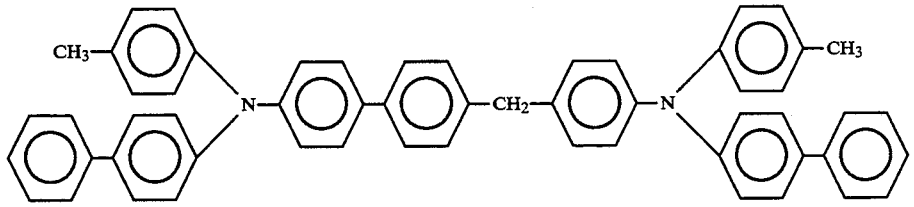
[13]
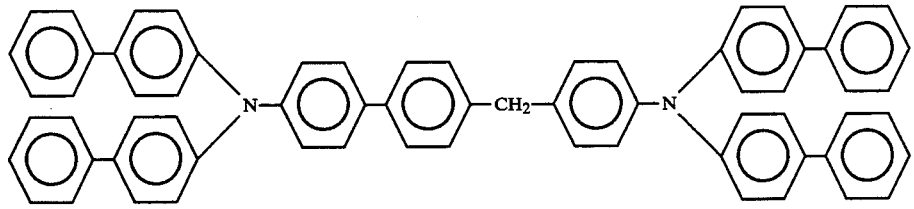

-continued
[14]
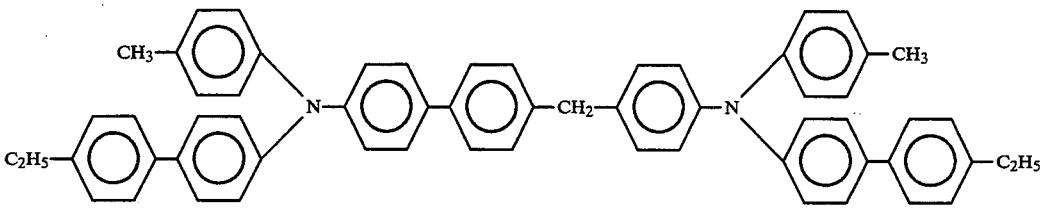
[15]
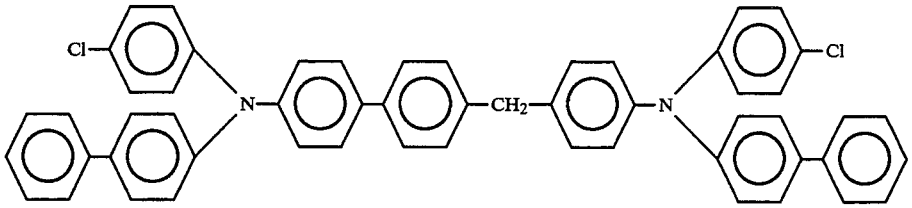
[16]
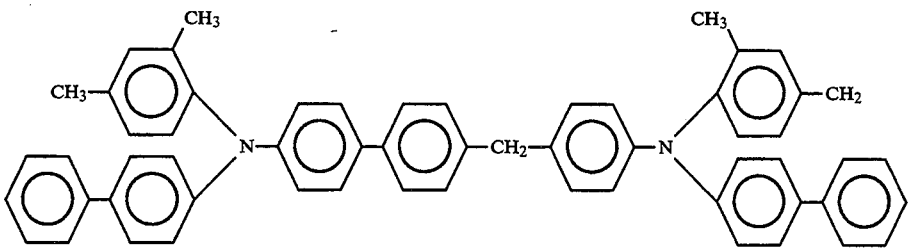
[17]
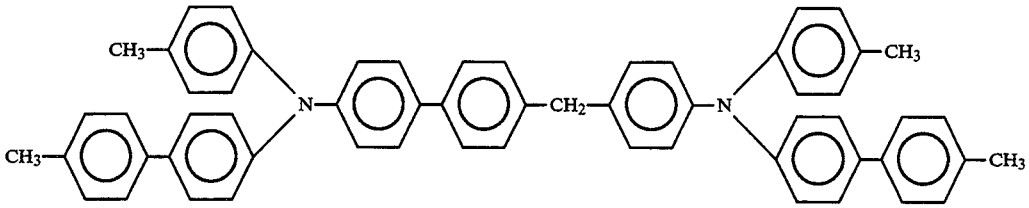
[18]
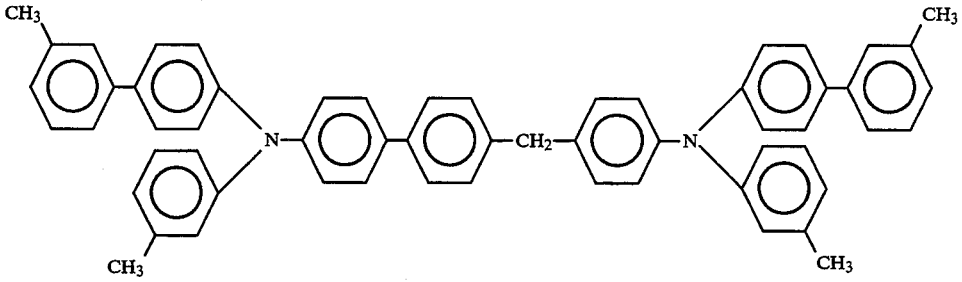
[19]
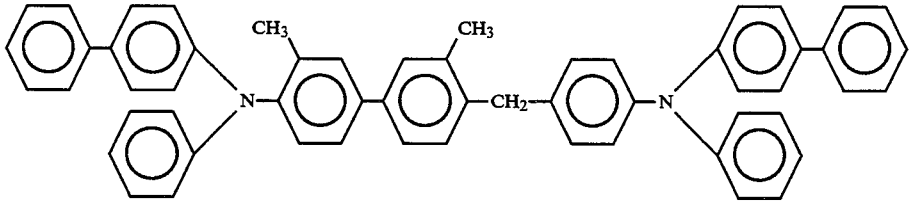
[20]
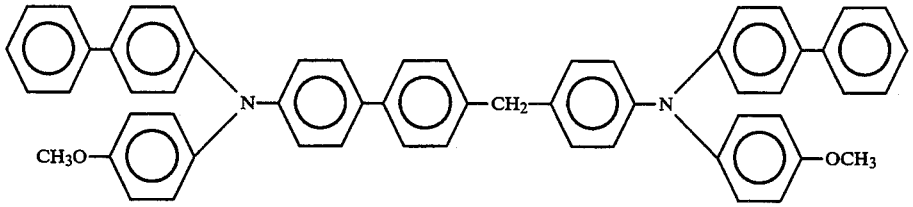

-continued
[21]
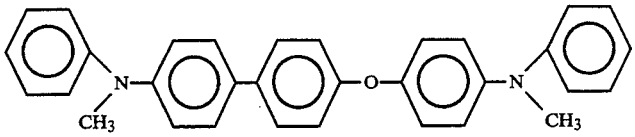
[22]
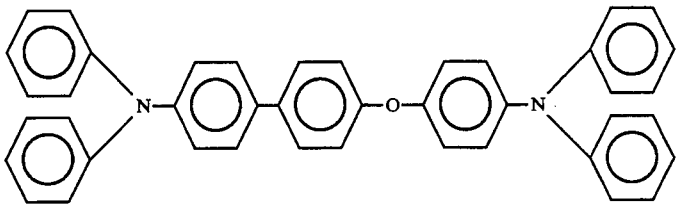
[23]
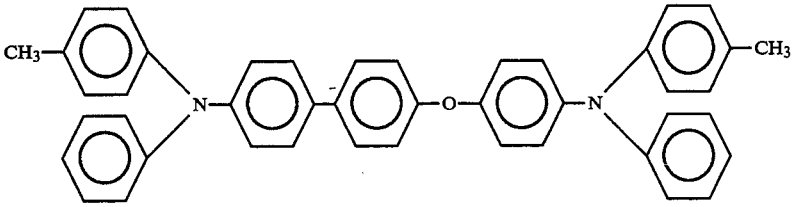
[24]
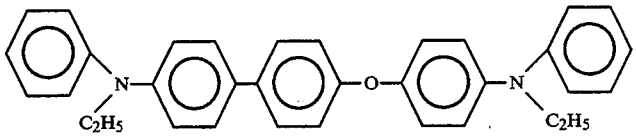
[25]
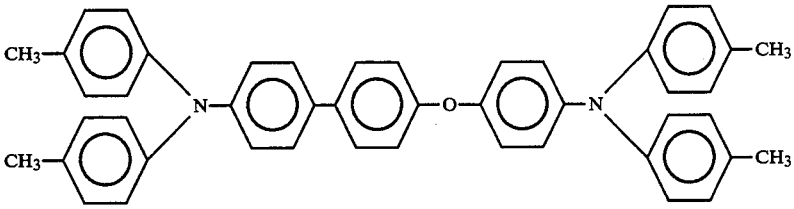
[26]
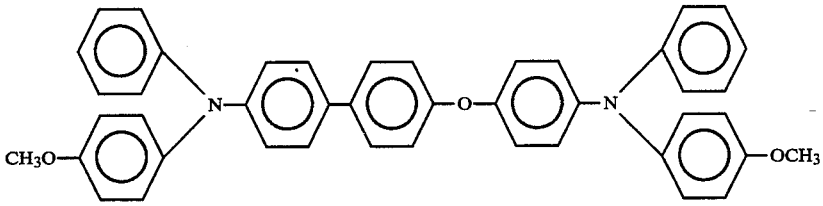
[27]
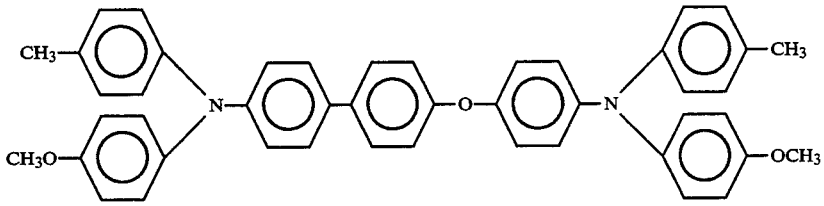
[28]
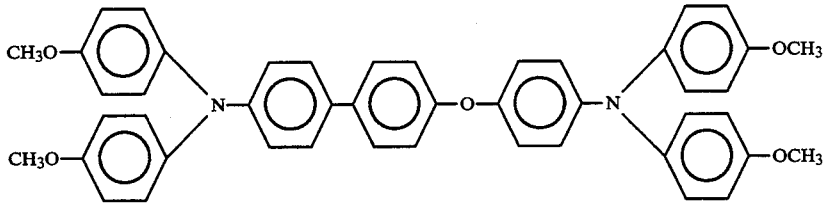

-continued
[29]
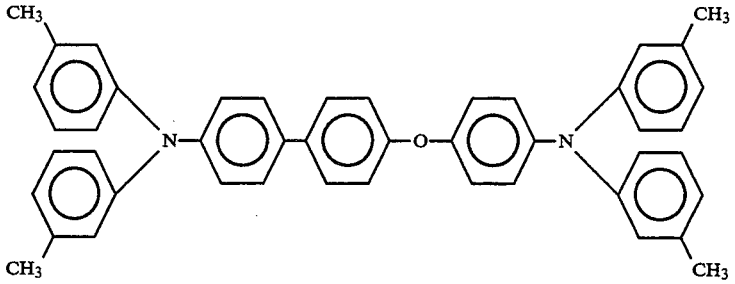
[30]
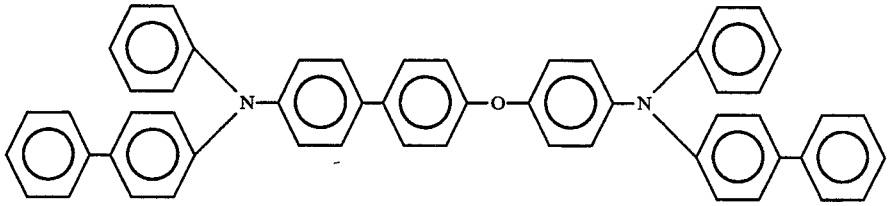
[31]
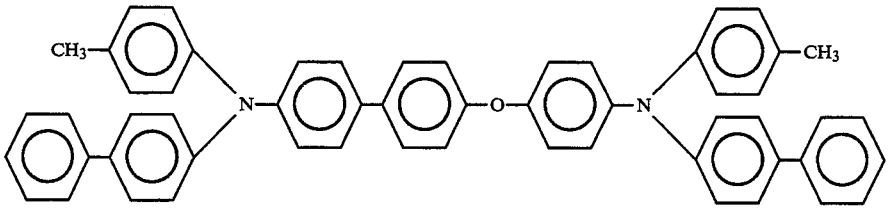
[32]
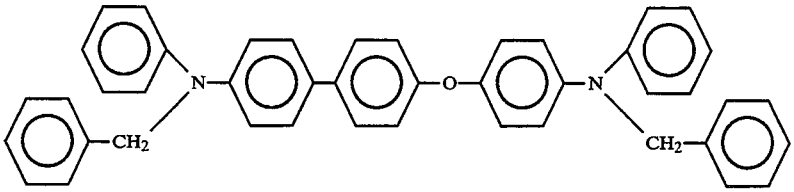
[33]
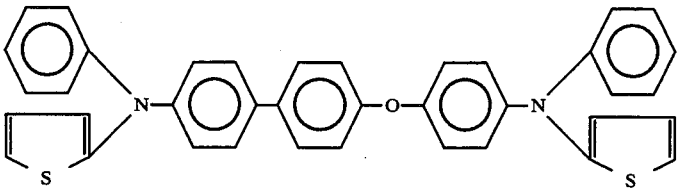
[34]
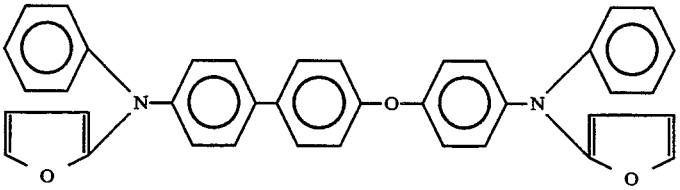
[35]
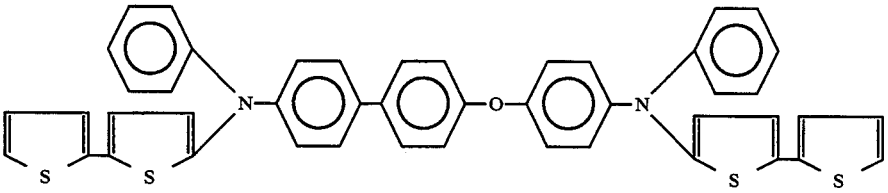

-continued
[36]
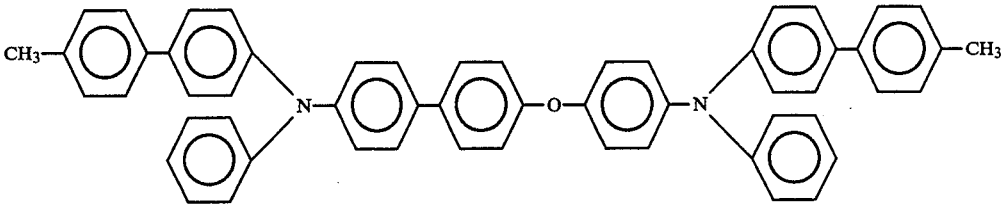
[37]
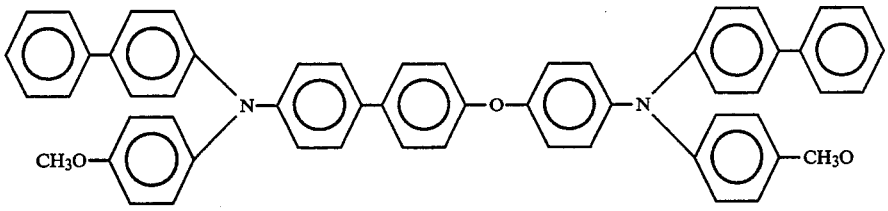
[38]
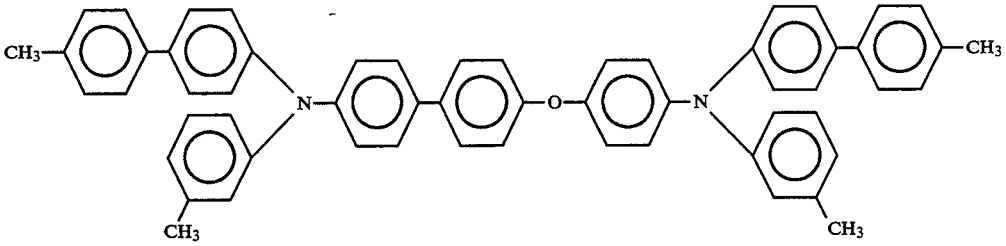
[39]
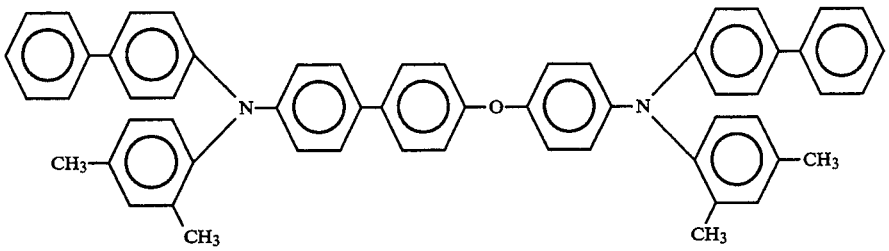
[40]
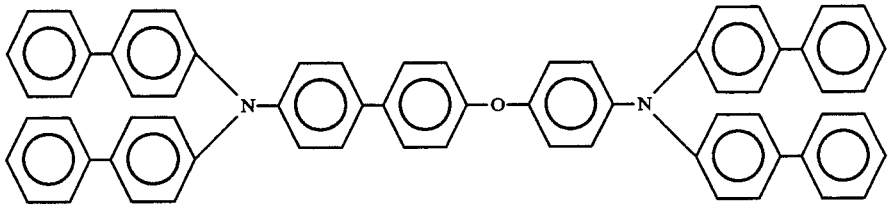
[41]
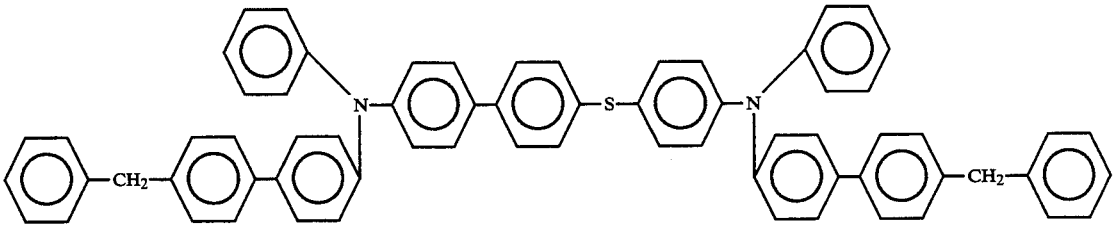

-continued
[42]
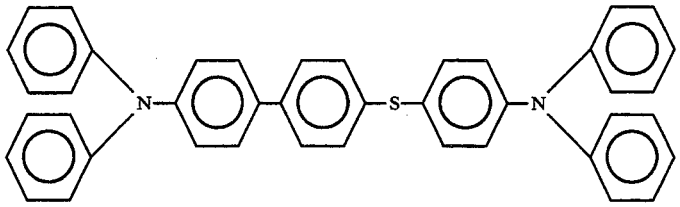
[43]
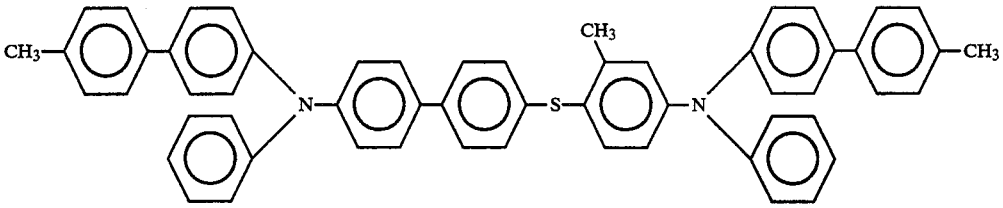
[44]
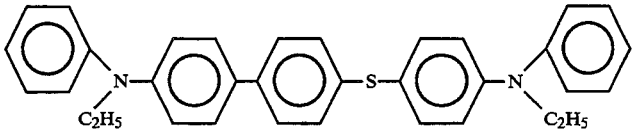
[45]
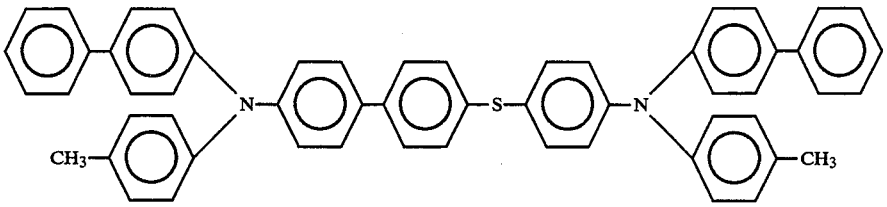
[46]
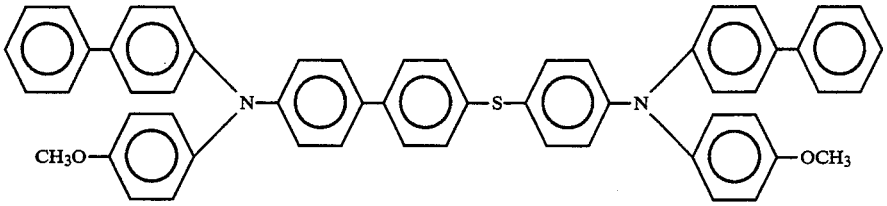
[47]
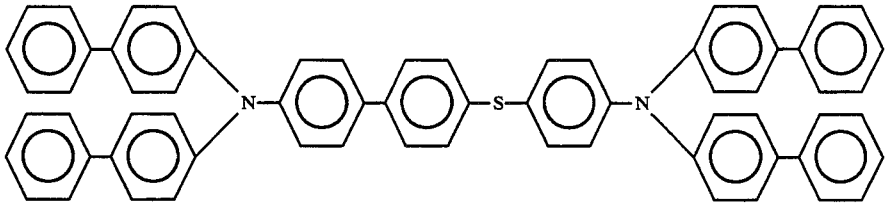
[48]
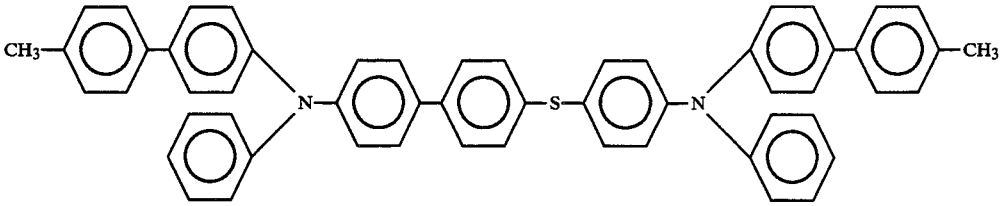

-continued
[49]
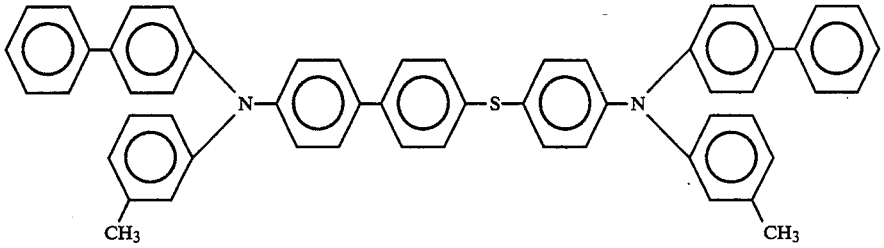
[50]
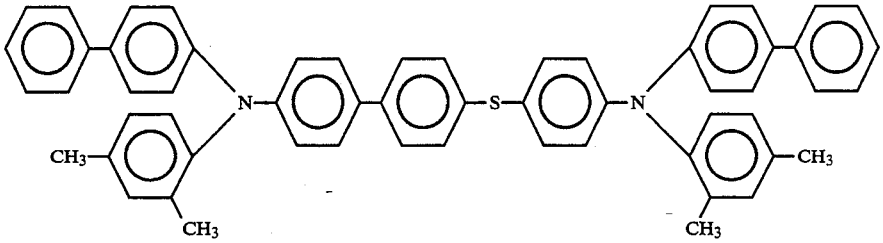
[51]
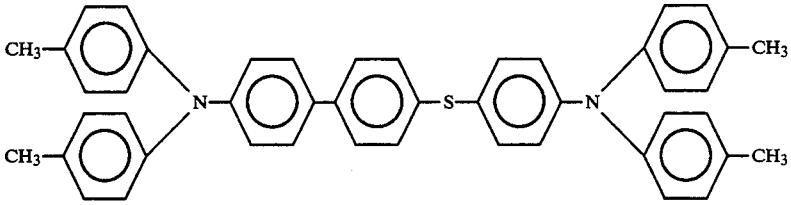
[52]
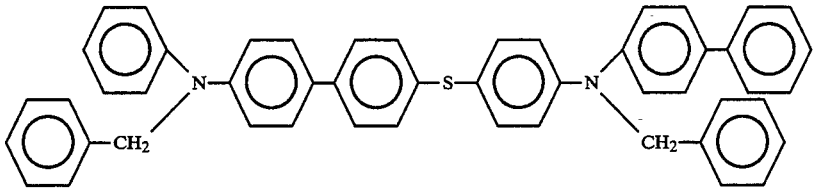
[53]
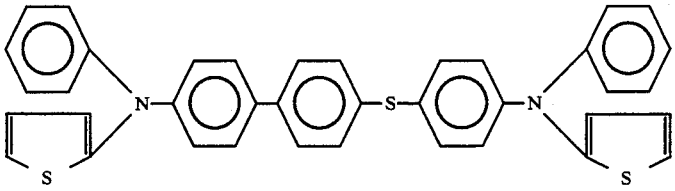
[54]
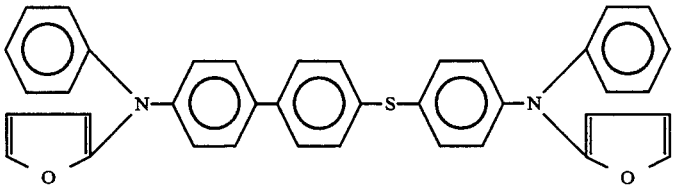
[55]
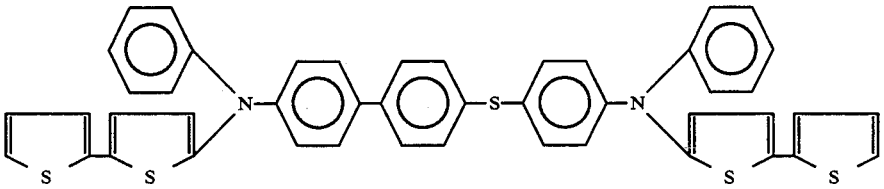

-continued
[56]
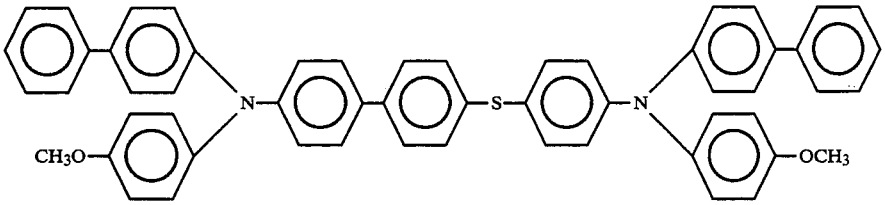
[57]
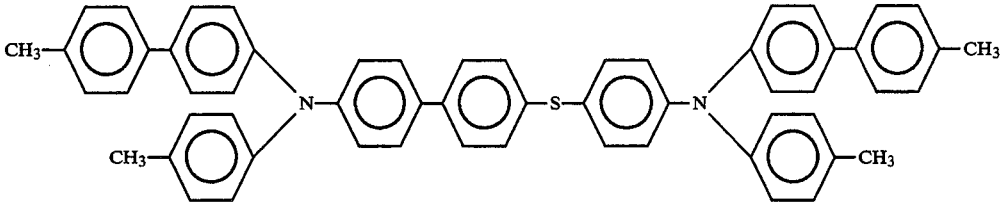
[58]
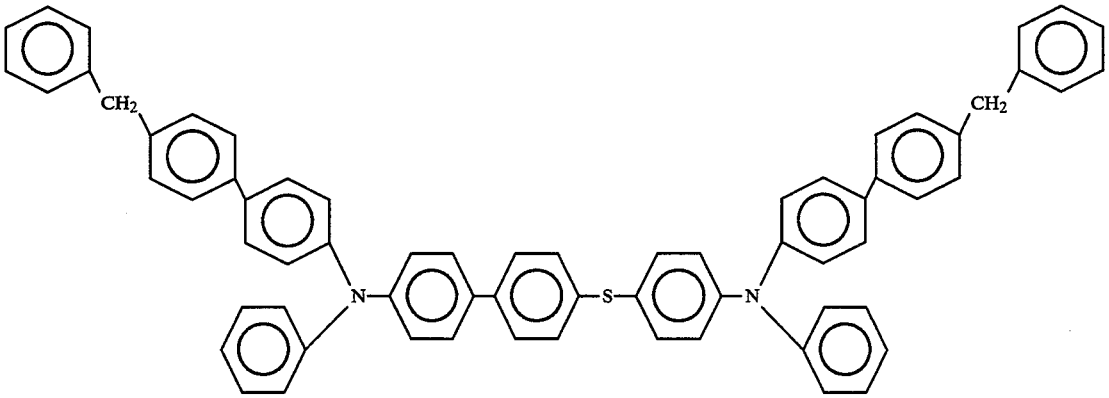
[59]
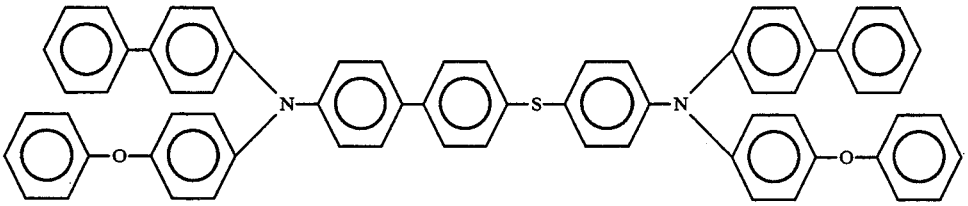
[60]
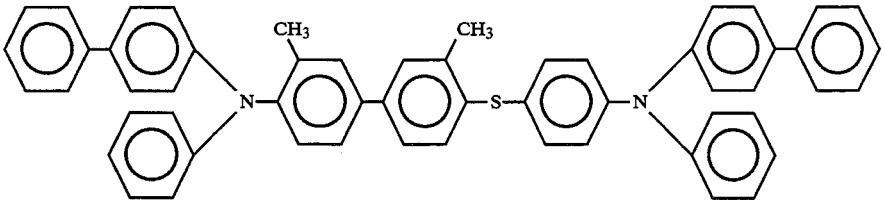
[61]
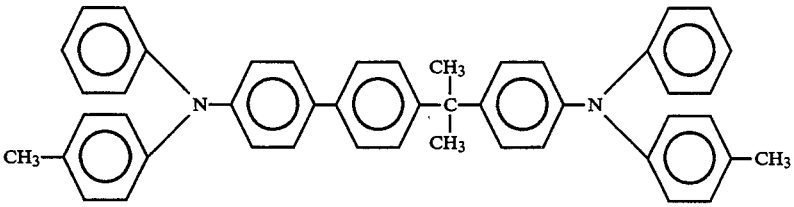

-continued
[62]
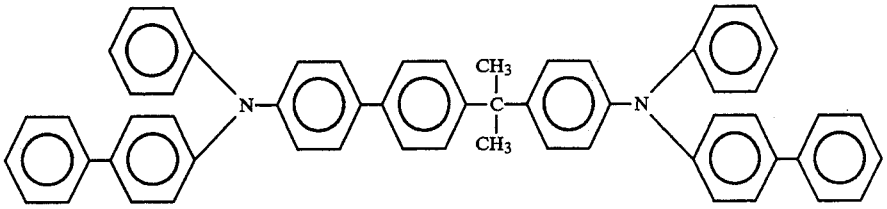
[63]
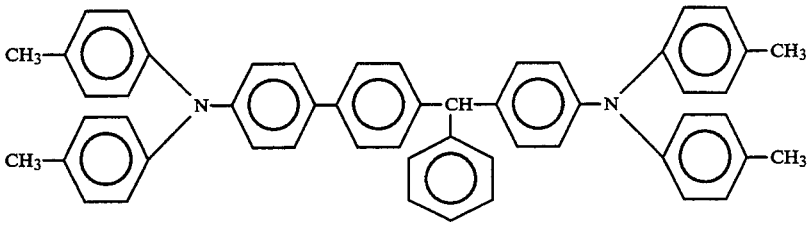
[64]
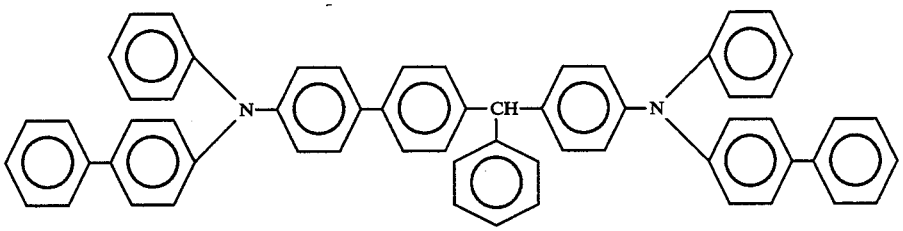
[65]
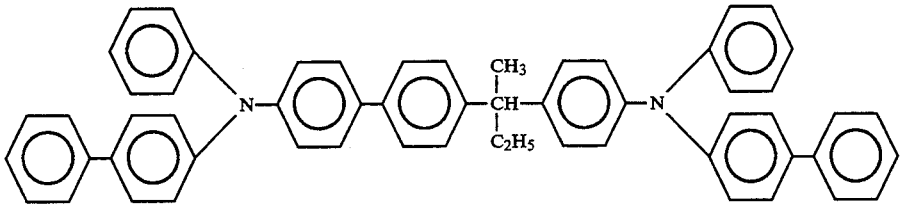
[66]
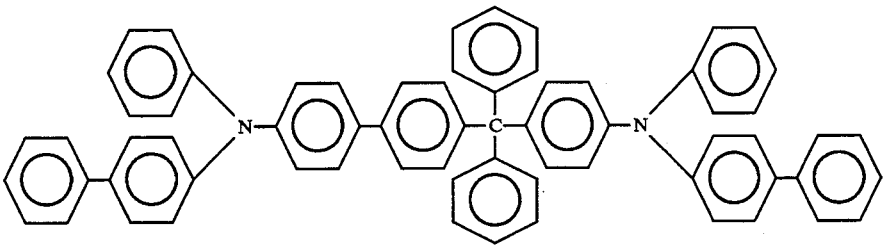
[67]
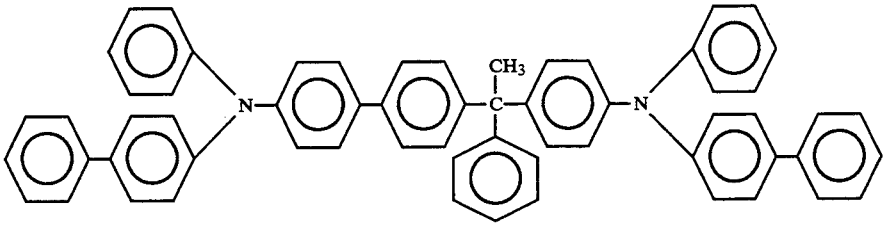
[68]
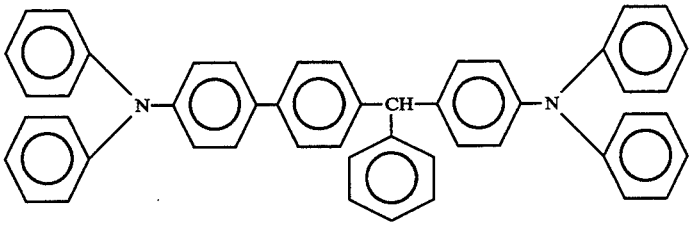

-continued
[69]
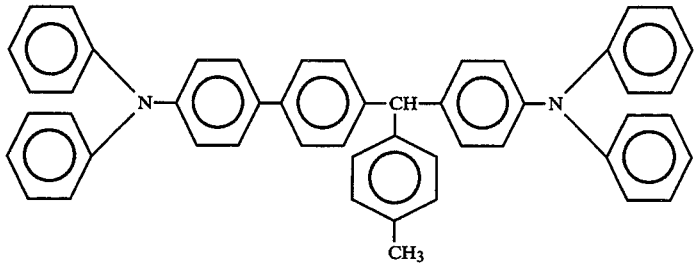
[70]
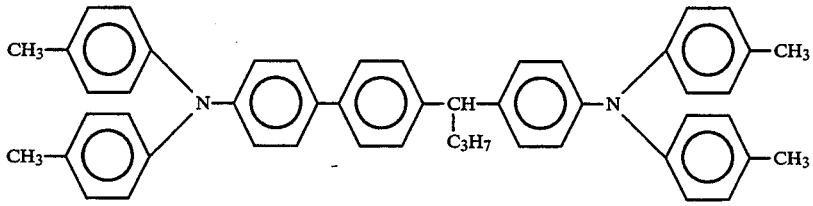
[71]
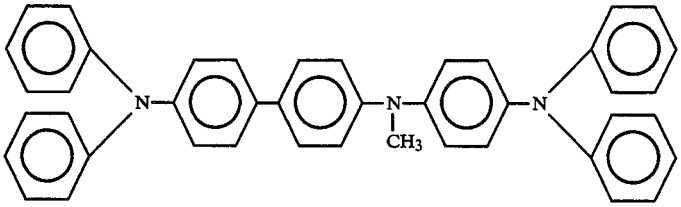
[72]
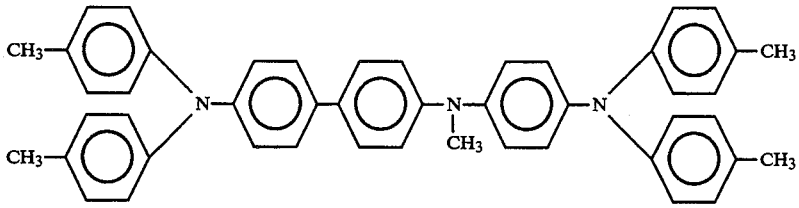
[73]
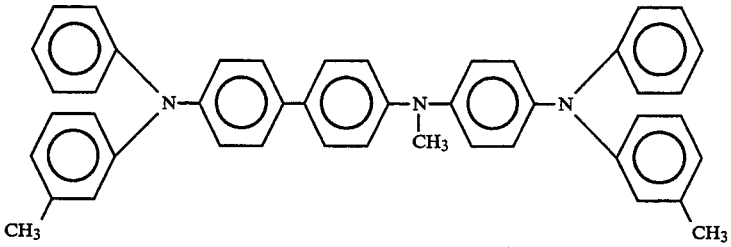
[74]
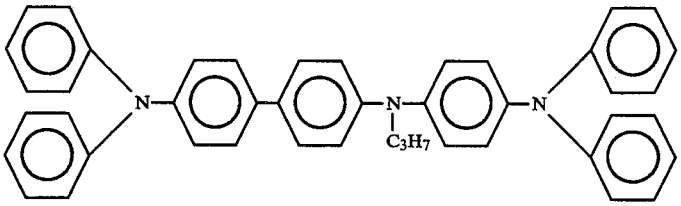

[75]
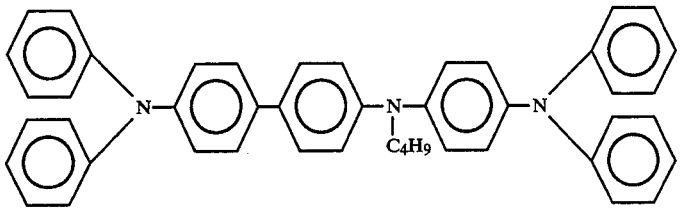
[76]
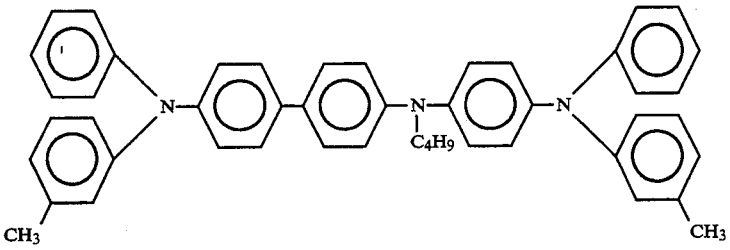
[77]
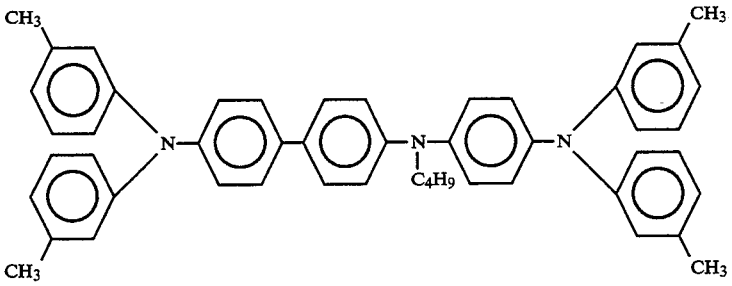
[78]
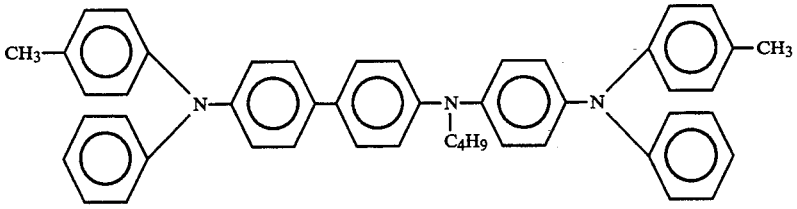
[79]
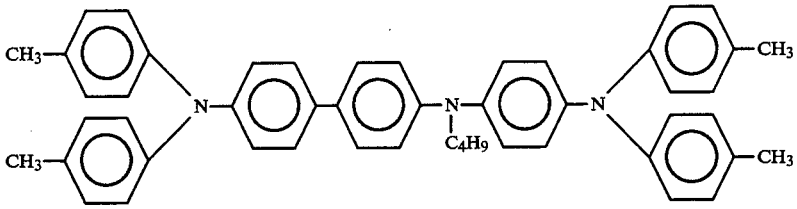
[80]
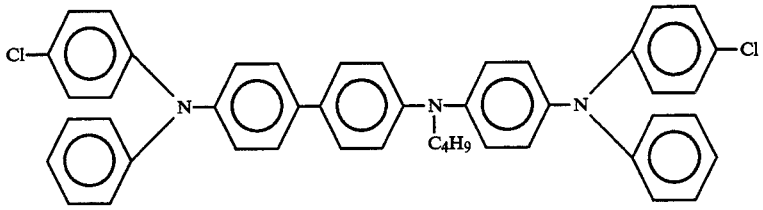
[81]
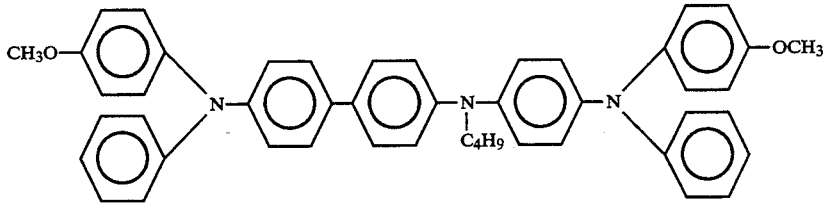

-continued
[82]
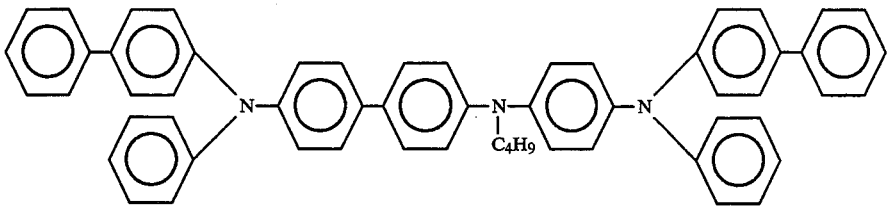
[83]
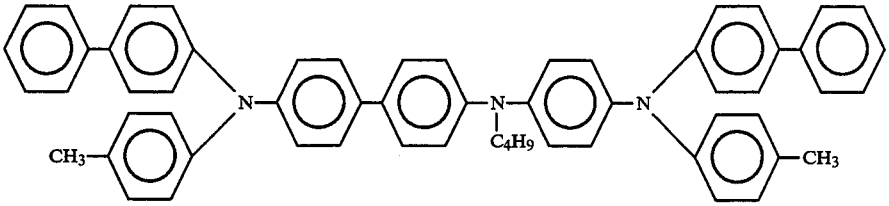
[84]
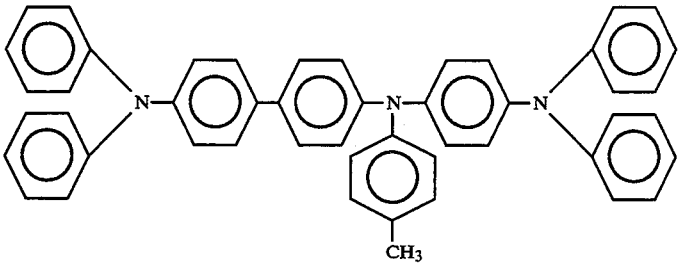
[85]
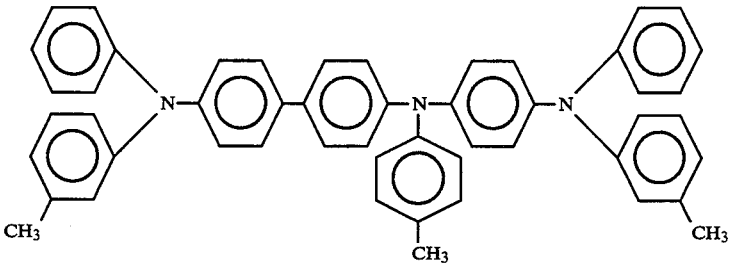
[86]
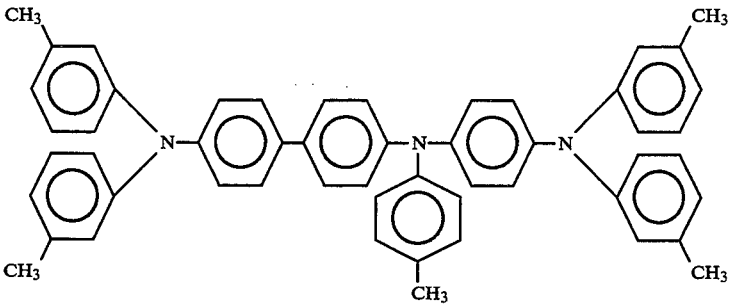
[87]
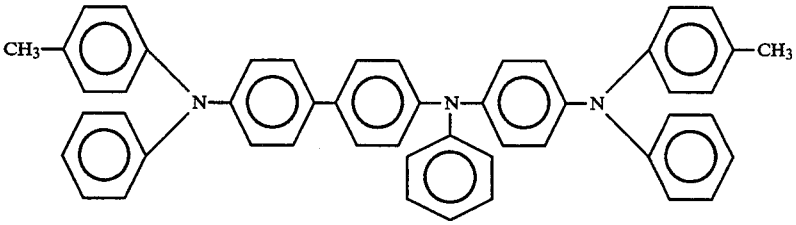

-continued
[88]
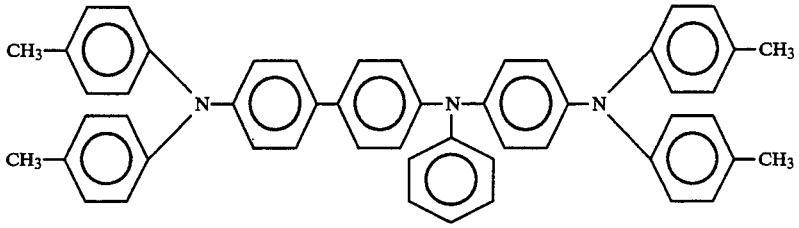
[89]
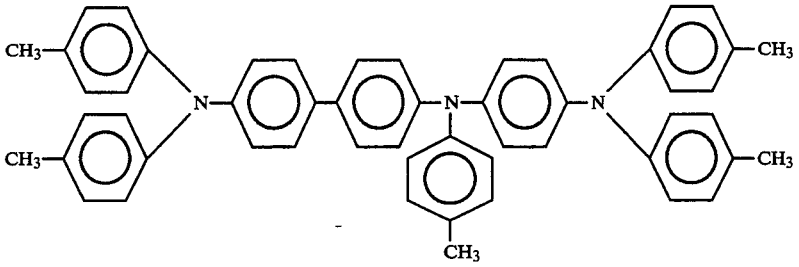
[90]
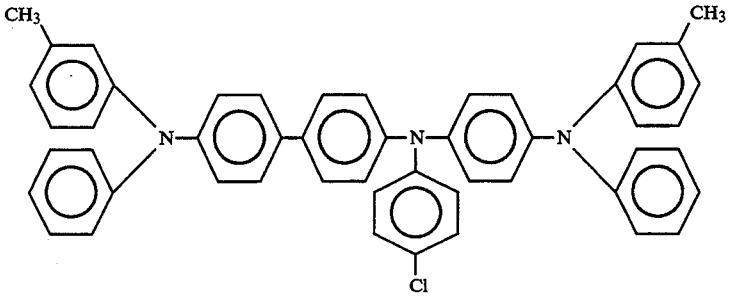
[91]
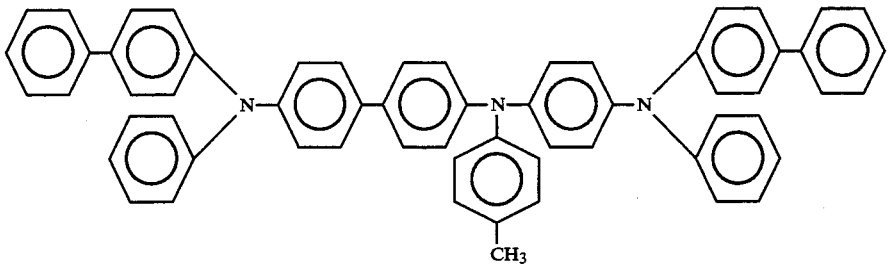
[92]
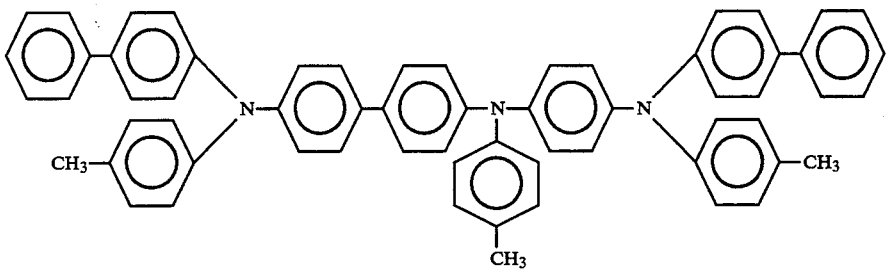
[93]
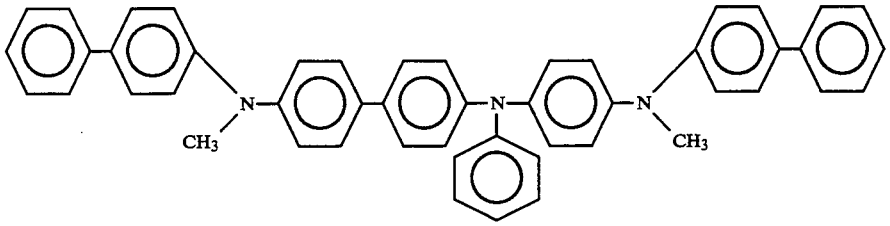

-continued
[94]
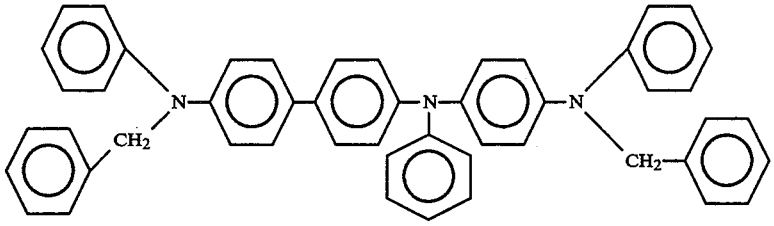
[95]
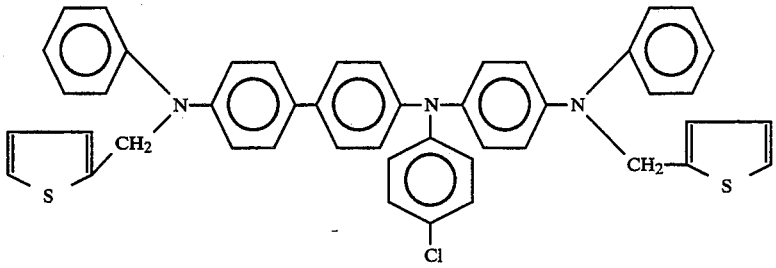
[96]
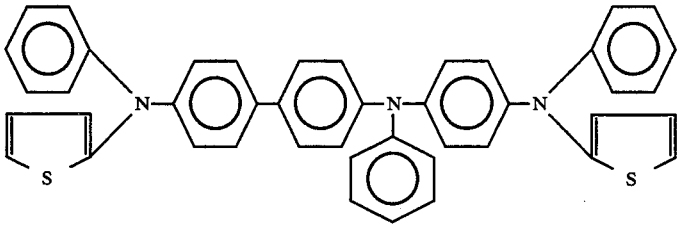
[97]
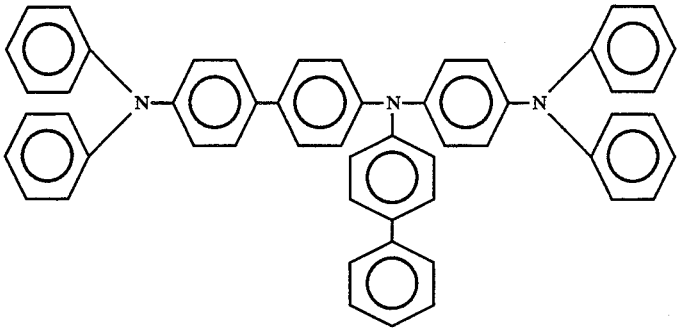
[98]
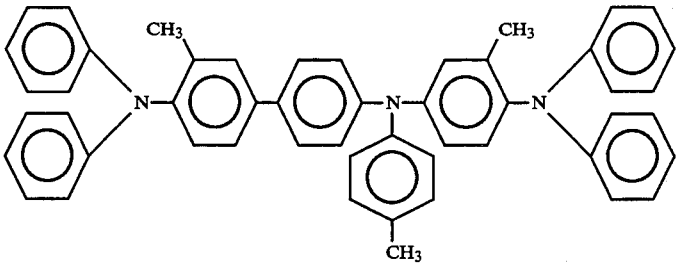
[99]
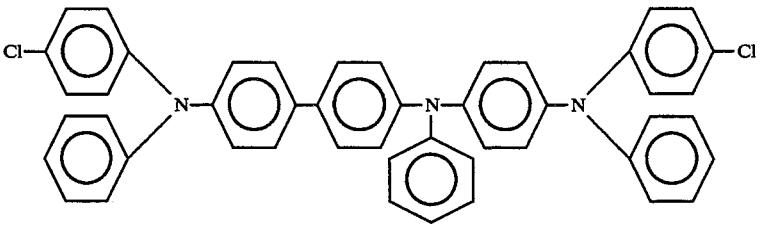

-continued
[100]
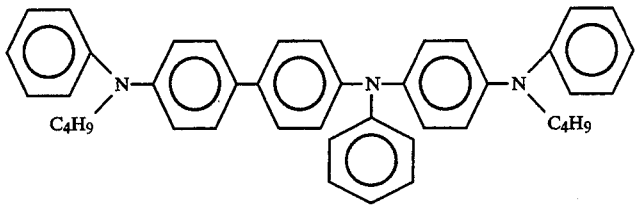
[101]
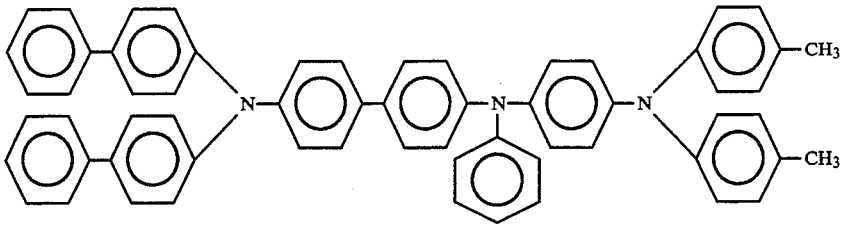
[102]
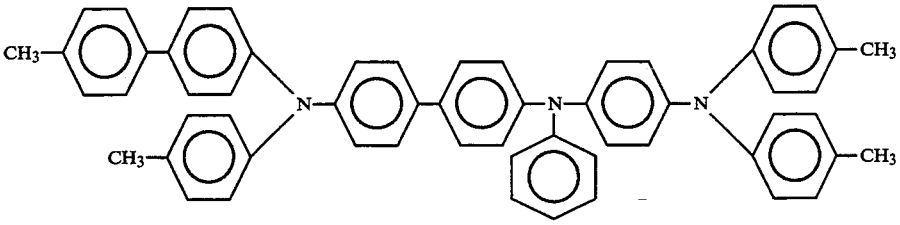
[103]
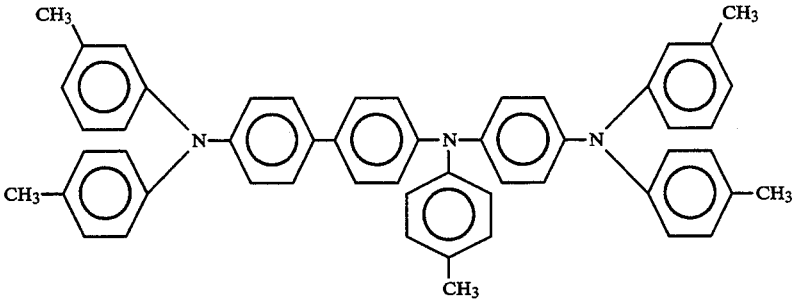
[104]
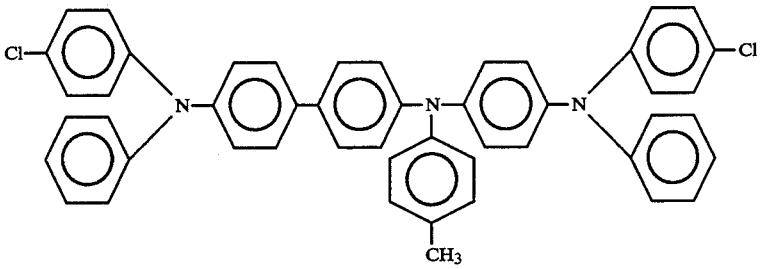
[105]
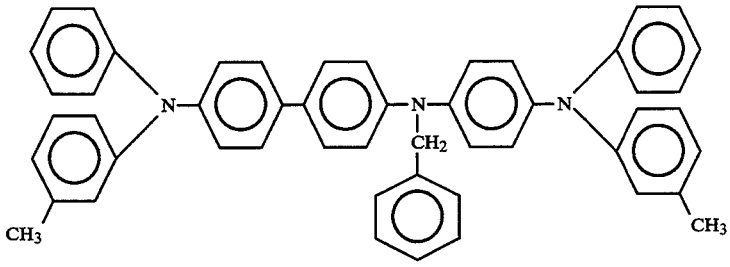

-continued

[106]

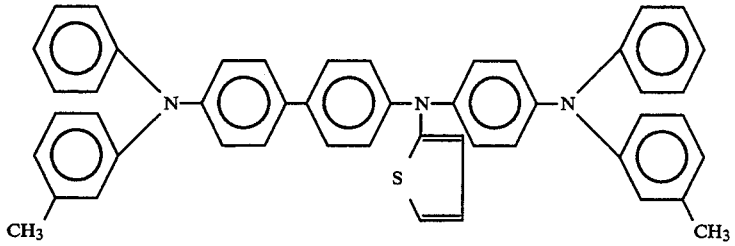

[107]

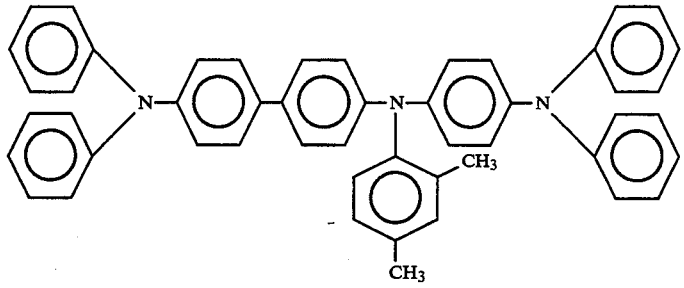

[108]

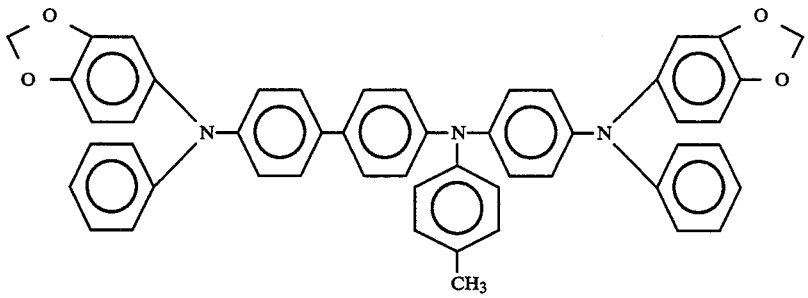

[109]

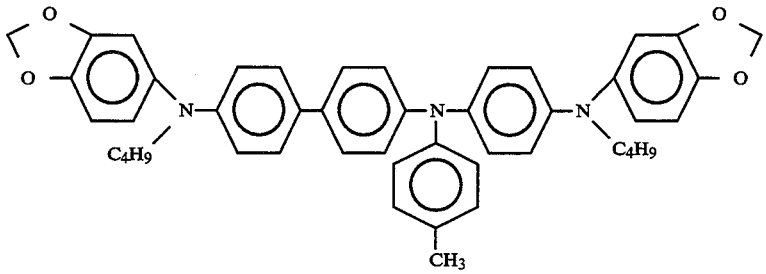

[110]

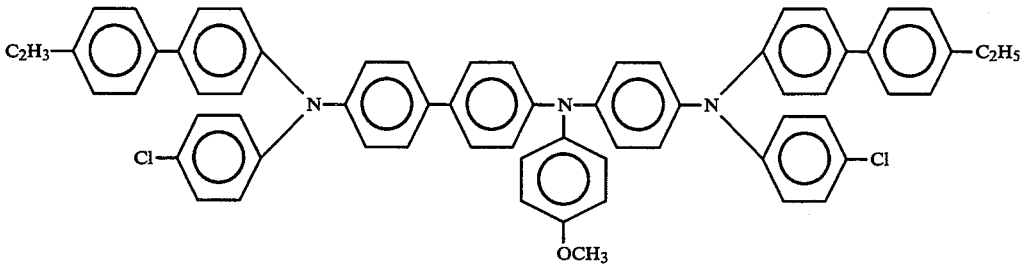

The present invention may be applied to any type of photosensitive members per se known. For example, there is known a photosensitive member of mono-layer type with a charge generating material and the amino compound dispersed in a binder resin on a substrate, or a so-called laminated type with a charge generating layer containing a charge generating material as a main component on a substrate, and a charge transporting layer on the charge generating layer. One or more of the amino compound of the present invention are used as a charge transporting material. The amino compound can carry effectively electrical charge given by charge generating materials by light-absorption.

Further, the amino compound of the present invention is excellent in ozone-resistance and light stability. Therefore, a photosensitive member becomes excellent in durability.

Moreover, the amino compound of the present invention has good compatibility with a binder resin, resulting in rare deposition of crystals and contribution to improvement of sensitivity and repetition properties.

The amino compound of the present invention may be used in combination with other charge transporting material.

A charge generating material useful for the present photosensitive member is exemplified by organic substances such as bisazo pigments, triarylmethane dyes, thiazine dyes, oxazine dyes, xanthene dyes, cyanine coloring agents, styryl coloring agents, pyrylium dyes, thiapyrylium dyes, azo pigments, quinacridone pigments, indigo pigments, perylene pigments, polycyclic quinone pigments, bisbenzimidazole pigments, indanthrone pigments, squalylium pigments, azulene coloring agents, phthalocyanine pigments and pyrrolopyrrole; and inorganic substances such as selenium, selenium-tellurium, selenium arsenic, cadmium sulfide, cadmium selenide, zinc oxide and amorphous silicon. Any other material is also usable insofar as it generates charge carriers very efficiency upon adsorption of light.

In particular, the use of an azo pigment having fluorenone structure as a charge generating material give a photosensitive member with high sensitivity.

The azo pigment having fluorenone structure represented by the following general formulas [II]–[IV] is preferable.

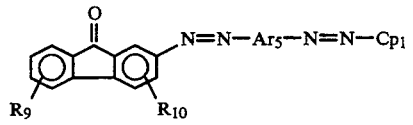

[II]

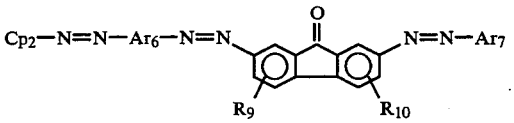

[III]

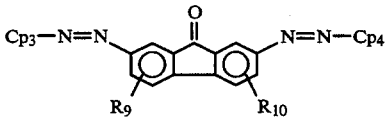

[IV]

In the formulas [II]–[IV], $R_9$ and $R_{10}$ are respectively a hydrogen atom, a halogen atom such as fluorine, chlorine, bromine and iodine, a nitro group, a hydroxy group. an alkyl group such as methyl, ethyl and propyl, an alkoxy group such as methoxy and ethoxy. $Ar_5$ and $Ar_6$ are respectively an arylene group such as phenylene, which may have a substituent.

$Ar_7$ represents an aryl group which may have a substituent or a residual group of a coupler component having a phenolic hydroxy group.

$Cp_1$–$Cp_4$ represent a residue of a coupler having phenolic hydroxy group and is exemplified by the following general formulas [a]–[j].

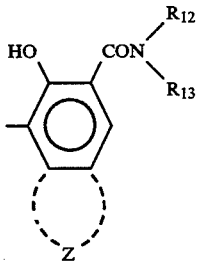

[a]

-continued

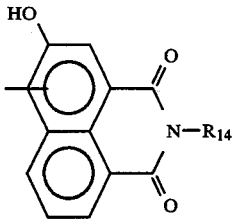

[b]

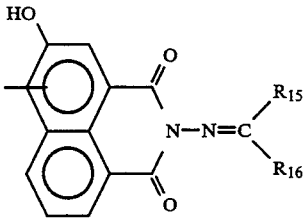

[c]

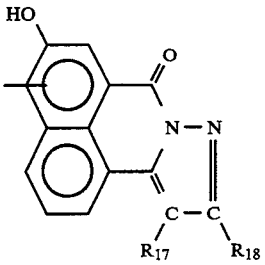

[d]

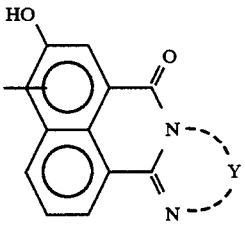

[e]

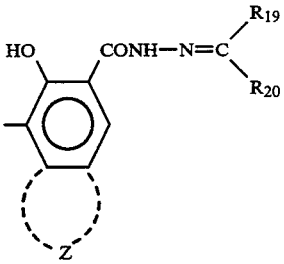

[f]

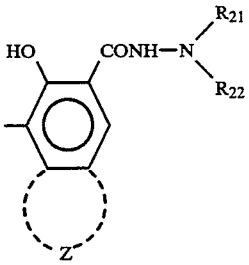

[g]

-continued

[h]

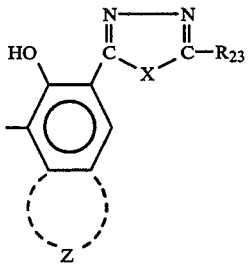

[i]

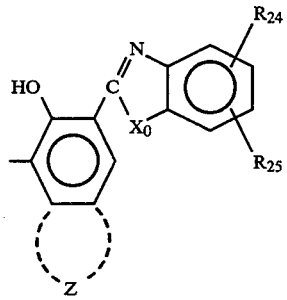

[j]

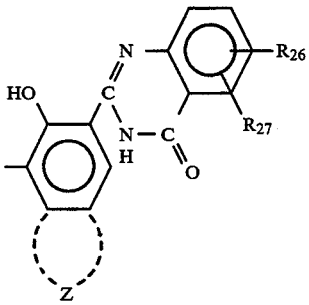

In the formula [a]–[j], $X_0$ is an oxygen atom, a sulfur atom or a nitrogen atom which may have a substituent. Y represents bivalent group of aromatic hydrocarbon or a bivalent group forming a heterocyclic ring in combination with the nitrogen atom. Z is a residue of a polycyclic conjugated ring or a heterocyclic ring condensed with the benzene ring. $R_{12}$, $R_{13}$, $R_{15}$, $R_{16}$, $R_{19}$, $R_{20}$, $R_{21}$, $R_{22}$ are respectively a hydrogen atom, an alkyl group, an aralkyl group, an aryl group or a heterocyclic group, each group of which may have a substituent. $R_{12}$ and $R_{13}$, $R_{15}$ and $R_{16}$, $R_{19}$ and $R_{20}$ and $R_{21}$ and $R_{22}$ may form a ring in combination. $R_{14}$ and $R_{23}$ are respectively an alkyl group, an aralkyl group, an aryl group or a heterocyclic group, each of which may have a substituent. $R_{17}$ and $R_{18}$ are respectively a hydrogen atom, a halogen atom, an alkyl group, an aralkyl group, an acyl group, an alkoxycarbonyl group, an aryl group, a condensed polycyclic group or a heterocyclic group, each group of which may have a substituent. $R_{24}$, $R_{25}$, $R_{26}$ and $R_{27}$ are respectively a hydrogen atom, a halogen atom, an alkyl group, a nitro group, a substituted one group, a carbamoyl group which may have a substituent at N-position, a sulfamoyl group which may have a substituent at N-position, an acylamino group which may have a substituent at N-position, or a phthtalimidyl group which may have a substituent at N-position. $R_{24}$ and $R_{25}$, $R_{26}$ and $R_{27}$ may form a ring in combination.

In particular, $R_{12}$, $R_{15}$, $R_{19}$ and $R_{21}$ are a hydrogen atom and $R_{13}$, $R_{16}$, $R_{20}$, $R_{22}$ and $R_{23}$ are a substituted phenyl group represented by the following general formula in preferable couplers having general formula [a], [c], [f], [g] and [h];

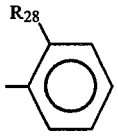

in which $R_{28}$ is a phenyl group having a substituent selected from the group consisting of a halogen atom, a nitro group, a cyano group and a trifluoromethyl group.

Concrete examples of the couplers are shown below.

[1]

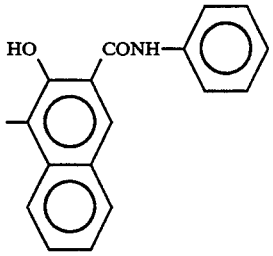

[2]

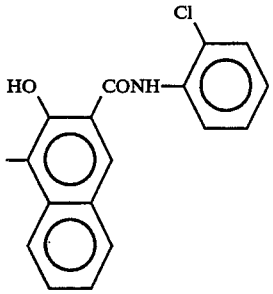

[3]

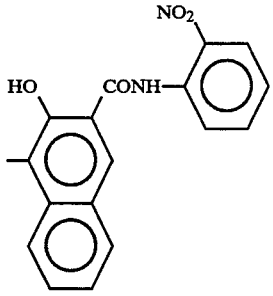

[4]

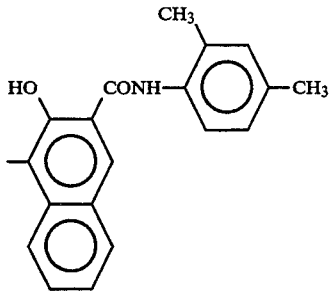

-continued
[5]
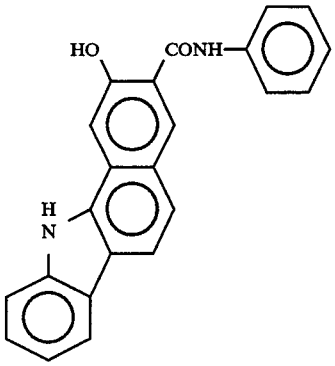
[6]
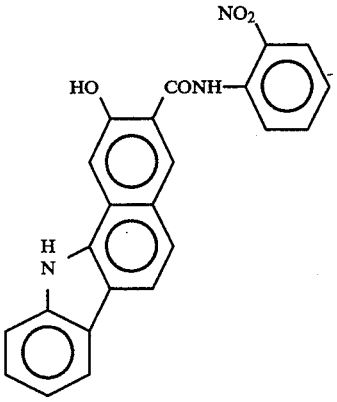
[7]
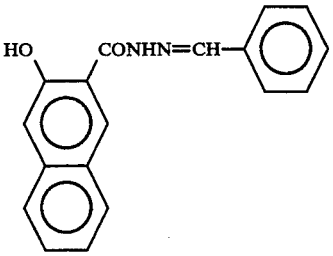
[8]
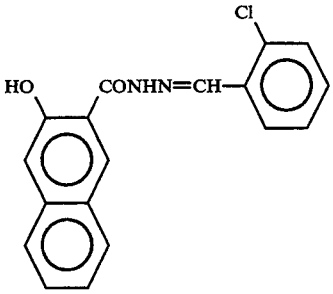
[9]
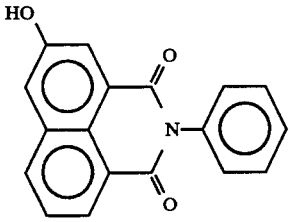
-continued
[10]
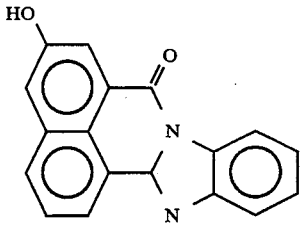
[11]
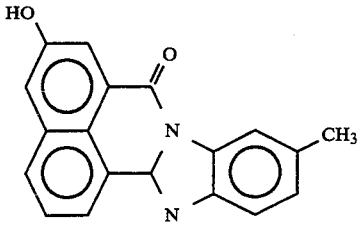
[12]
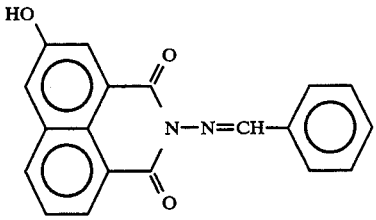
[13]
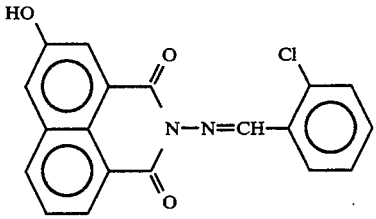
[14]
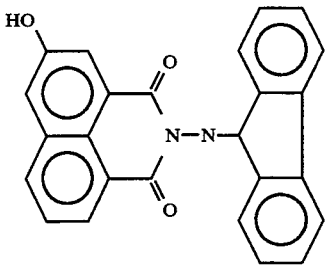
[15]
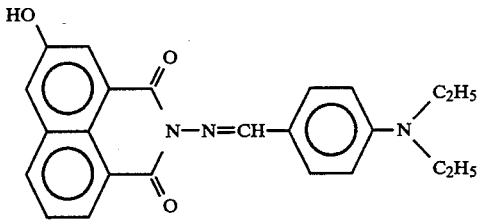

-continued
[16]
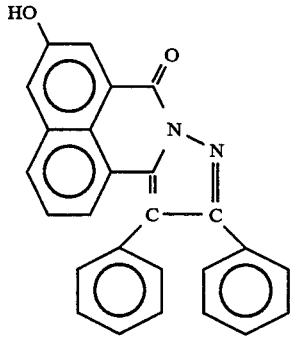
[17]
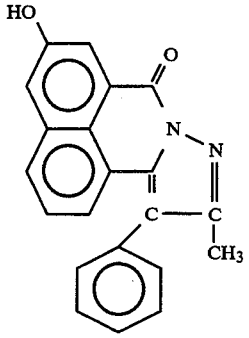
[18]
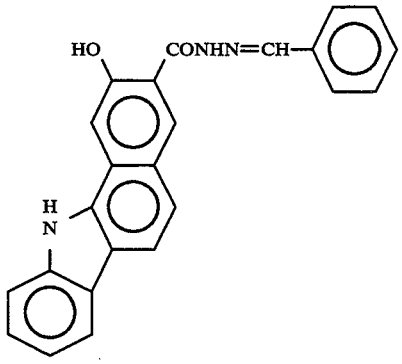
[19]
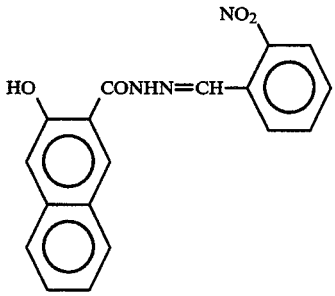
-continued
[20]
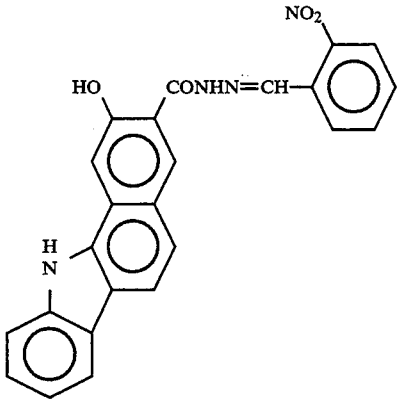
[21]
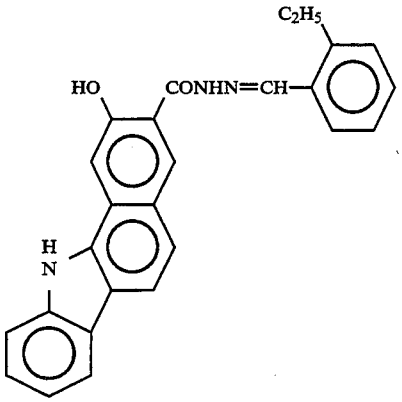
[22]
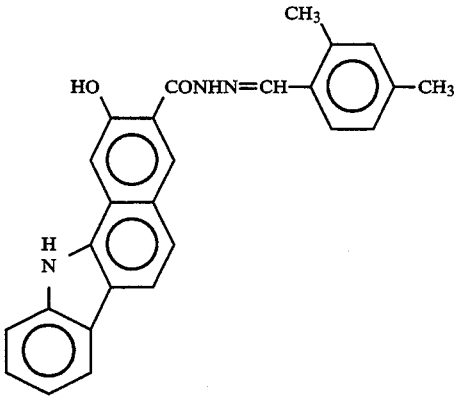
[23]
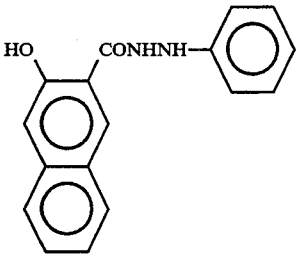

-continued
[24]
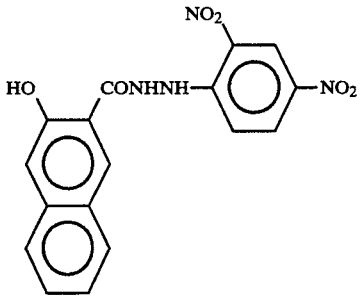
[25]
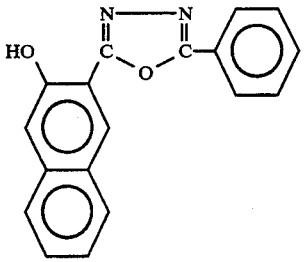
[26]
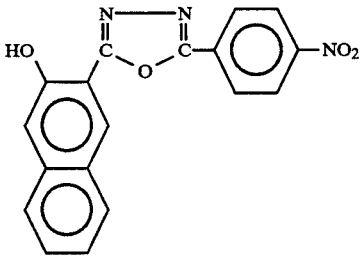
[27]
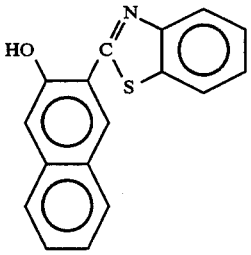
[28]
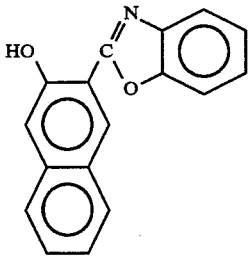
[29]
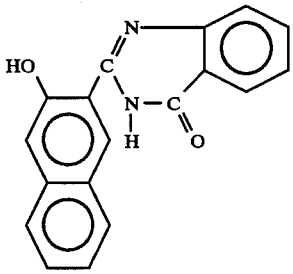
-continued
[30]
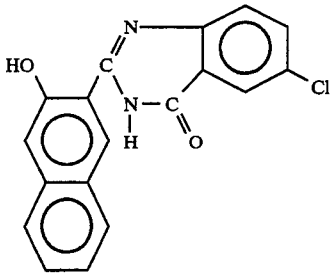
[31]
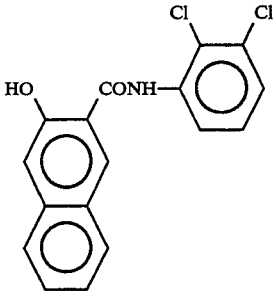
[32]
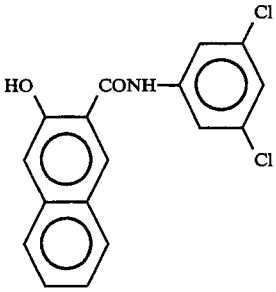
[33]
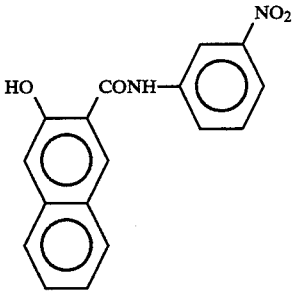
[34]
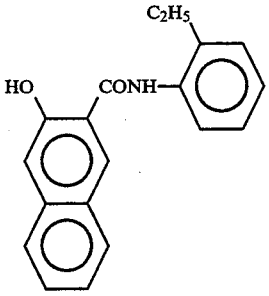

-continued
[35]
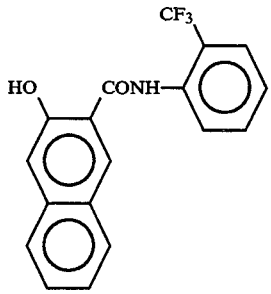
[36]
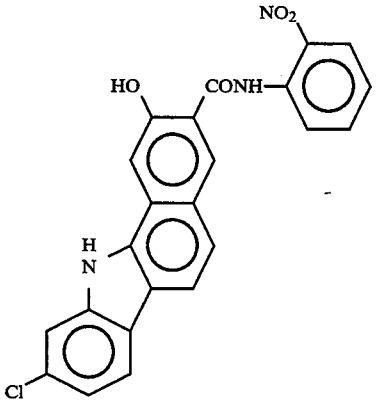
[37]
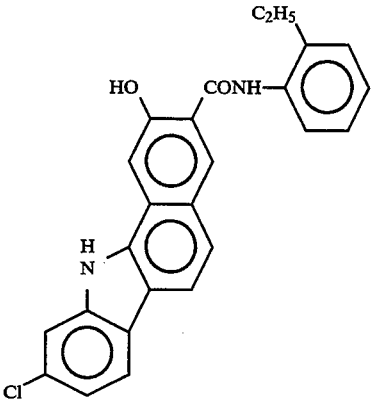
[38]
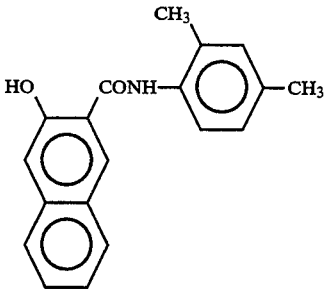
[39]
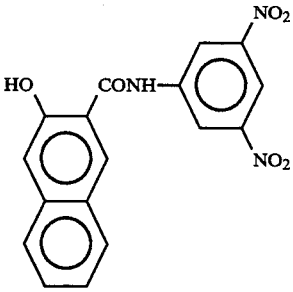
-continued
[40]
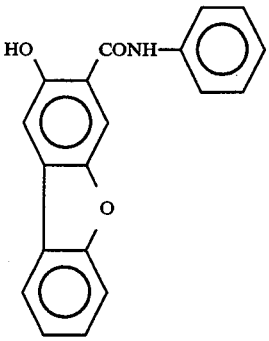
[41]
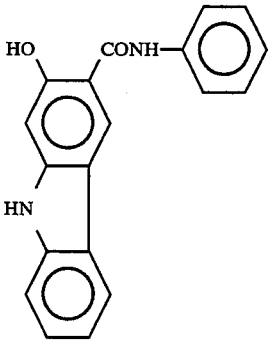
[42]
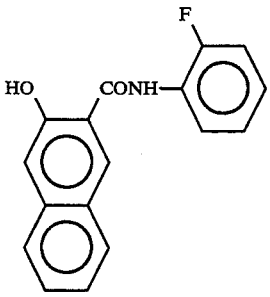
[43]
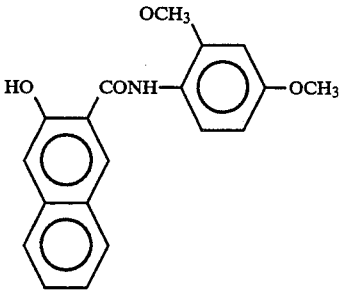
[44]
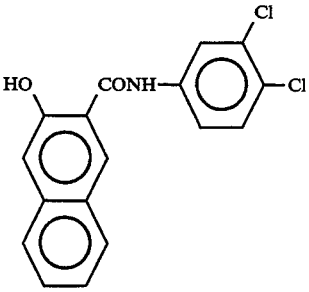

-continued

[45]

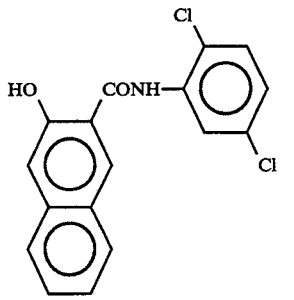

A pyrrolopyrrole compound represented by the following general formula [V] can be used as a charge generating material.

[V]

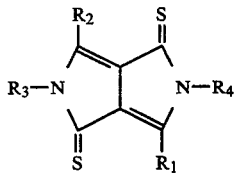

In the formula [V], $R_1$ and $R_2$ are respectively an alkyl group, an aralkyl group, a cycloalkyl group or an aryl group, each of which may have a substituent.

$R_3$ and $R_4$ are respectively a hydrogen atom on a substituent which does not give a solubility in water.

$R_1$ and $R_2$ are respectively an alkyl group such as methyl, ethyl and propyl, a cycloalkyl group such as cyclohexyl and cyclopentyl, an aryl group such as phenyl, naphthyl, anthryl, phenanthryl, fluorenyl and 1-pyrenyl, or an aralkyl group such as benzyl, phenethyl and naphthylmethyl. Preferably, an aryl group is phenyl or naphthyl.

The alkyl group, the aralkyl group, the aryl group and the cycloalkyl group may have a substituent exemplified by an alkyl group such as methyl and ethyl, an alkoxy group such as methoxy and ethoxy a halogen atom such as chlorine and bromine, a nitro group and disubstituted amino group. Preferably, the substituent for the aryl group and the aralkyl group is a halogen atom such as fluorine, chlorine, bromine and iodine, a lower alkyl group having a halogen atom such as chloromethyl, dichloromethyl, trichloromethyl, 2-chloroethyl, 2,2-dichloroethyl, 2,2,2-trichloroethyl and trifluoromethyl, cyano group, alkyl group, alkoxy group and dialkylamino group. $R_3$ and $R_4$ is respectively a hydrogen atom, an alkyl group, an aralkyl group, an aryl group or a heterocyclic group.

Concrete compounds represented by the general formula [V] are exemplified by;

1,4-dithioketo-3,6-diphenylpyrrolo[3,4-c]pyrrole;
1,4-dithioketo-3,6-di(tolyl)pyrrolo[3,4-c]pyrrole;
1,4-dithioketo-3,6-di(4-ethylphenyl)pyrrolo[3,4-c]pyrrole;
1,4-dithioketo-3,6-di(4-propylphenyl)pyrrolo[3,4-c]pyrrole;
1,4-dithioketo-3,6-di(4-isopropylphenyl)pyrrolo[3,4-c]pyrrole;
1,4-dithioketo-3,6-di(4-butylphenyl)pyrrolo[3,4-c]pyrrole;
1,4-dithioketo-3,6-di(4-isobutylphenyl)pyrrolo[3,4-c]pyrrole;
1,4-dithioketo-3,6-di(4-tert-butylphenyl)pyrrolo[3,4-c]pyrrole;
1,4-dithioketo-3,6-di(4-pentylphenyl)pyrrolo[3,4-c]pyrrole;
1,4-dithioketo-3,6-di(4-hexylphenyl)pyrrolo[3,4-c]pyrrole;
1,4-dithioketo-3,6-di(3,5-dimethylphenyl)pyrrolo[3,4-c]pyrrole;
1,4-dithioketo-3,6-di(3,4,5-trimethylphenyl)pyrrolo[3,4-c]pyrrole; 1,4-dithioketo-3,6-di(4-methoxyphenyl)-pyrrolo[3,4-c]pyrrole;
1,4-dithioketo-3,6-di(4-ethoxyphenyl)pyrrolo[3,4-c]pyrrole;
1,4-dithioketo-3,6-di(4-propoxyphenyl)pyrrolo[3,4-c]pyrrole;
1,4-dithioketo-3,6-di(4-isopropoxyphenyl)pyrrolo[3,4-c]pyrrole;
1,4-dithioketo-3,6-di(4-butoxyphenyl)pyrrolo[3,4-c]pyrrole;
1,4-dithioketo-3,6-di(4-isobutoxyphenyl)pyrrolo[3,4-c]pyrrole;
1,4-dithioketo-3,6-di(4-tert-butoxyphenyl)pyrrolo[3,4-c]pyrrole:
1,4-dithioketo-3,6-di(4-pentyloxyphenyl)pyrrolo[3,4-c]pyrrole;
1,4-dithioketo-3,6-di(4-hexyloxyphenyl)pyrrolo[3,4-c]pyrrole;
1,4-dithioketo-3,6-di(3,5-dimethoxyphenyl)pyrrolo[3,4-c]pyrrole;
1,4-dithioketo-3,6-di(3,4,5-trimethoxyphenyl)pyrrolo[3,4-c]pyrrole;
1,4-dithioketo-3,6-dibenzylpyrrolo[3,4-c]pyrrole;
1,4-dithioketo-3,6-dinaphthylpyrrolo[3,4-c]pyrrole;
1,4-dithioketo-3,6-di(4-cyanophenyl)pyrrolo[3,4-c]pyrrole;
1,4-dithioketo-3,6-di(4-chlorophenyl)pyrrolo[3,4-c]pyrrole;
1,4-dithioketo-3,5-di(2-bromophenyl)pyrrolo[3,4-c]pyrrole;
1,4-dithioketo-3,6-di (4-trifluoromethylphenyl)pyrrolo[3,4-c]pyrrole;
1,4-dithioketo-3,6-di(4-dimethylaminophenyl)pyrrolo[3,4-c]pyrrole;
1,4-dithioketo-3,6-di(4-diethylaminophenyl)pyrrolo[3,4-c]pyrrole; N,N'-dimethyl-1,4-dithioketo-3,6-diphenylpyrrolo[3,4-c]pyrrole;
N,N'-dimethyl-1,4-dithioketo-3,6-ditolylpyrrolo[3,4-c]pyrrole;
N,N'-dimethyl-1,4-dithioketo-3,6-di(4-ethylphenyl)pyrrolo[3,4-c]pyrrole;
N,N'-dimethyl-1,4-dithioketo-3,6-di(4-isopropylphenyl)pyrrolo[3,4-c]pyrrole;
N,N'-dimethyl-1,4-dithioketo-3,6-di(4-tert-butylphenyl)pyrrolo[3,4-c]pyrrole;
N,N'-dimethyl-1,4-dithioketo-3,6-di(3,4,5-trimethylphenyl)pyrrolo[3,4-c]pyrrole;
N,N'-dimethyl-1,4-dithioketo-3,6di(4-methoxyphenyl)-pyrrolo[3,4-c]pyrrole;
N,N'-dimethyl-1,4-dithioketo-3,6-di(4-ethoxyphenyl)-pyrrolo[3,4-c]pyrrole;
N,N'-dimethyl-1,4-dithioketo-3,6-di(4-isopropoxyphenyl)pyrrolo[3,4-c]pyrrole;
N,N'-dimethyl-1,4-dithioketo-3,6-di(4-tert-butoxyphenyl)pyrrolo[3,4-c]pyrrole;
N,N'-dimethyl-1,4-dithioketo-3,6-di(3,4,5-trimethoxyphenyl)pyrrolo[3,4-c]pyrrole;
1,4-dithioketo-3,6-di(3-pyrrolyl)pyrrolo[3,4-c]pyrrole;
1,4-dithioketo-3,6-di(4-oxazolyl)pyrrolo[3,4-c]pyrrole;

1,4-dithioketo-3,6-di(4-thiazolyl)pyrrolo[3,4-c]pyrrole;
1,4-dithioketo-3,6-diimidazolylpyrrolo[3,4-c]pyrrole;
1,4-dithioketo-3,6-di(2-imidazolyl)pyrrolo[3,4-c]pyrrole;
1,4-dithioketo-3,6-di(4-imidazolyl)pyrrolo[3,4-c]pyrrole;
1,4-dithioketo-3,6-di(4-pyridyl)pyrrolo[3,4-c]pyrrole;
1,4-dithioketo-3,6-di(2-pyrimidinyl)pyrrolo[3,4-c]pyrrole;
1,4-dithioketo-3,6-dipiperidinopyrrolo[3,4-c]pyrrole;
1,4-dithioketo-3,6-di(4-piperidyl)pyrrolo[3,4-c]pyrrole;
1,4-dithioketo-3,6-dimorpholinopyrrolo[3,4-c]pyrrole;
1,4-dithioketo-3,6-di(2-quinolyl)pyrrolo[3,4-c]pyrrole;
1,4-dithioketo-3,6-di(3-benzo[b]thiophenyl)pyrrolo[3,4-c]pyrrole;
N,N'-dimethyl-1,4-dithioketo-3,6-di(4-imidazolyl)pyrrolo[3,4-c]pyrrole;
N,N'-dimethyl-1,4-dithioketo-3,6-dimorpholinopyrrolo[3,4-c]pyrrole;
N,N'-dimethyl-1,4-dithioketo-3,6-di(4-pyridyl)pyrrolo[3,4-c]pyrrole.

Any of these pyrrolopyrrole compounds represented by the general formula [V ] can be used singly or in combination with some pyrrolopyrrole compounds.

A compound represented by the following general formula [VI ] can be used as a charge generating material.

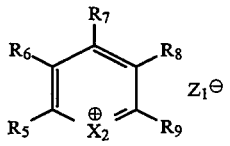

[VI]

In the formula [VI], $R_5$, $R_6$, $R_7$, $R_8$ and $R_9$ are respectively a hydrogen atom, an alkyl group typically having from one to 15 carbon atoms, such as methyl, ethyl, isopropyl, butyl, t-butyl, amyl, isoamyl, hexyl, octyl, nonyl and dodecyl, an alkoxy group such as methoxy, ethoxy, propoxy, butoxy, amyloxy, hexyloxy and octyloxy and an aryl group such as phenyl, 4-diphenyl, alkylphenyl (for example, 4-ethylphenyl, 4-propylphenyl, 4-amyloxyphenyl, 2-hexyloxyphenyl, 2-methoxyphenyl and 3,4-dimethoxyphenyl ), β-hydroxyalkoxyphenyl (for example, 2-hydroxyethoxyphenyl and 3-hydroxyethoxyphenyl), 4-hydroxyphenyl, halophenyl (for example, 2,4-dichlorophenyl, 3,4-dibromophenyl. 4-chlorophenyl or 3,4-dichlorophenyl), azidophenyl, nitrophenyl, aminophenyl (for example, 4-diethylaminophenyl or 4-dimethylaminophenyl), naphthyl and an aryl group substituted by vinyl group (for example, styryl, methoxystyryl, diethoxystyryl, dimethylaminostyryl, 1-butyl-4-p-dimethylaminophenyl-1,3-butadienyl or β-ethyl-4-dimethylaminostyryl).

In the formula [VI], $X_2$ is oxygen, sulfur or selenium. The compound represented by the formula [VI] of which $X_2$ is oxygen is pyrylium dye salts. The compound of which $X_2$ is sulfur is thiapyrylium dye salts. The compound of which $X_2$ is selenium is selenapyrylium dye salts.

$Z_1^-$ is an anionic functional group such as perchlorate, fluoroborate, iodide, chloride, bromide, sulfate, hexafluorophosphate($PF_4$), hexafluoroantimonate($SbF_4$), hexafluoroarsenate($AsF_4$), periodide and p-toluensulfonate.

$R_5$ and $R_6$ and/or $R_8$ and $R_9$ may form an aryl ring in combination.

Concrete compounds represented by the general formula [VI] are exemplified below;

(1c) 4-[4-bis-2(chloroethyl)aminophenyl]-2,6-diphenylthiapyryliumperchlorate
(2c) 4-(4-dimethylaminophenyl)-2,6-diphenylthiapyryliumperchlorate
(3c) 4-(4-dimethylaminophenyl)-2,6-phenylthiapyryliumfluoroborate
(4c) 4-(4-dimethylamino-2-methylphenyl)-2,6-diphenylpyryliumperchlorate
(5c) 4-[4-bis(2-chloroethyl)aminophenyl)-2-(4-methoxyphenyl)-6-phenylthiapyryliumperchlorate
(6c) 4-(4-dimethylaminophenyl)-2,6-diphenylthiapyryliumsulfate
(7c) 4-(4-dimethylaminophenyl)-2,6-diphenylthiapyrylium-p-toluenesulfonate
(8c) 4-(4-dimethylaminophenyl)-2,6-diphenylpyrylium-p-toluenesulfonate
(9c) 2-(2,4-diethoxyphenyl)-4-(4-dimethylaminophenyl)benzo[b]pyrylium-perchlorate
(10c) 2,6-bis(4-ethylphenyl)-4-(4-dimethylaminophenyl)thiapyryliumperchlorate
(11c) 4-(4-dimethylaminophenyl)-2-(4-methoxyphenyl)-6-phenylthiapyryliumperchlorate
(12c) 4-(4-dimethylaminophenyl)-2-(4-ethoxyphenyl)-6-phenylthiapyryliumperchlorate
(13c) 4-(4-dimethylaminophenyl)-2-(4-methoxyphenyl)-6-(4-methylphenyl)pyryliumperchlorate
(14c) 4-(4-diphenylaminophenyl)-2,6-diphenylthiapyryliumperchlorate
(15c) 2,4,6-triphenylpyryliumperchlorate
(16c) 4-(4-methoxyphenyl)-2,6-diphenylpyryliumperchlorate
(17c) 4-(2,4-dichlorophenyl)-2,6-diphenylpyryliumperchlorate
(18c) 4-(3,4-dichlorophenyl)-2,6-diphenylpyryliumperchlorate
(19c) 2,6-bis(4-methoxyphenyl)-4-phenylpyryliumperchlorate
(20c) 6-(4-methoxyphenyl)-2,4-diphenylpyryliumperchlorate
(21c) 2-(3,4-dichlorophenyl)-4-(4-methoxyphenyl) -6-phenylpyryliumperchlorate
(22c) 4-(4-amyloxyphenyl)-2,6-bis(4-ethylphenyl)-pyryliumperchlorate
(23c) 4-(4-amyloxyphenyl)-2,6-bis(4-methoxyphenyl)-pyryliumperchlorate
(24c) 2,4,6-triphenylpyryliumfluoroborate
(25c) 2,6-bis(4-ethylphenyl)-4-(4-methoxyphenyl)-pyryliumperchlorate
(26c) 2,6-bis(4-ethylphenyl)-4-(4-methoxyphenyl)-pyryliumfluoroborate
(27c) 6-(3,4-diethoxystyryl)-2,4-diphenylpyryliumperchlorate
(28c) 6-(3,4-diethoxy-β-amylstyryl)-2,4-diphenylpyryliumfluoroborate
(29c) 6-(4-dimethylamino-β-ethylstyryl)-2,4-diphenylpyryliumfluoroborate
(30c) 6-(1-n-amyl-4-p-dimethylaminophenyl-1,3-butadienyl)2,4-diphenylpyryliumfluoroborate
(31c) 6-(4-dimethylaminostyryl)-2,4-diphenylpyryliumfluoroborate
(32c) 6-[α-ethyl-β,β-bis(dimethylaminophenyl)-vinylene]2,4-diphenylpyryliumfluoroborate
(33c) 6-(1-butyl-4-p-dimethylaminophenyl-1,3-butadienyl)2,4-diphenylpyryliumfluoroborate
(34c) 6-(4-dimethylaminostyryl)-2,4-diphenylpyryliumperchlorate (35c) 6- [β,β-bis(4-dimethylaminophenyl)vinylene]-2,4-diphenylpyryliumperchlorate
(36c) 2,6-bis(4-dimethylaminostyryl)-4-phenylpyryliumperchlorate
(37c) 6-(β-methyl-4-dimethylaminostyryl)-2,4-diphenylpyryliumfluoroborate
(38c) 6-[1-ethyl-4-(4-dimethylaminophenyl)-1,3-butadienyl]2,4-diphenyl-pyryliumfluoroborate
(39c) 6-[β,β-bis(4-dimethylaminophenyl)vinylene]-2,4-diphenylpyryliumfluoroborate
(40c) 6-[1-methyl-4-(4-dimethylaminophenyl)-1,3-butadienyl]2,4-diphenyl-pyryliumfluoroborate
(41c) 4-(4-dimethylaminophenyl)-2,6-diphenylpyryliumperchlorate
(42c) 2,6-bis(4-ethylphenyl)-4-phenylpyryliumperchlorate
(43c) 2,6-bis(4-ethylphenyl)-4-methoxyphenylthiapyryliumfluoroborate
(44c) 2,4,6-triphenylthiapyryliumperchlorate
(45c) 4-(4-methoxyphenyl)-2,6-diphenylthiapyryliumperchlorate
(46c) 6-(4-methoxyphenyl)-2,4-diphenylthiapyryliumperchlorate
(47c) 2,6-bis(4-methoxyphenyl)-4-phenylthiapyryliumperchlorate
(48c) 4-(2,4-dichlorophenyl)-2,6-diphenylthiapyryliumperchlorate
(49c) 2,4,6-tri(4-methoxyphenyl)thiapyryliumperchlorate
(50c) 2,6-bis(4-ethylphenyl)-4-phenylthiapyryliumperchlorate
(51c) 4-(4-amyloxyphenyl)-2,6-bis(4-ethylphenyl)thiapyryliumperchlorate
(52c) 6-(4-dimethylaminostyryl)-2,4-diphenylthiapyryliumperchlorate
(53c) 2,4,6-triphenylthiapyryliumfluoroborate
(54c) 2,4,6-triphenylthiapyryliumsulfate
(55c) 4-(4-methoxyphenyl)-2,6-diphenylthiapyryliumfluoroborate
(56c) 2,4,6-triphenylthiapyryliumchloride
(57c) 2-(4-amyloxyphenyl)-4,6-diphenylthiapyryliumfluoroborate
(58c) 4-(4-amyloxyphenyl)-2,6-bis(4-methoxyphenyl)thiapyryllumperchlorate
(59c) 2,6-bis(4-ethylphenyl)-4-(4-methoxyphenyl)thiapyrylium perchlorate
(60c) 4-anisyl-2,6-bis(4-n-amyloxyphenyl)thiapyryliumchloride
(61c) 2-[β,β-bis(4-dimethylaminophenyl)vinylene]-4,6diphenylthiapyryliumperchlorate
(62c) 6-(β-ethyl-4-dimethylaminostyryl)-2,4-diphenylthiapyryliumperchlorate
(63c) 2-(3,4-diethoxystyryl)-4,6-diphenylthiapyryliumperchlorate
(64c) 2,4,6-trianisylthiapyryliumperchlorate
(65c) 6-ethyl-2,4-diphenylpyryliumfluoroborate
(66c) 2,6-bis(4-ethylphenyl)-4-(4-methoxyphenyl)thiapyryliumchloride
(67c) 6-[β,β-bis(4-dimethylaminophenyl)vinylene]-2,4-di(4-ethylphenyl)pyryliumperchlorate
(68c) 2,6-bis(4-amyloxyphenyl)-4-(4-methoxyphenyl)thiapyryliumperchlorate
(69c) 6-(3,4-diethoxy-β-ethylstyryl)-2,4-diphenylpyryliumfluoroborate
(70c) 6-(4-methoxy-β-ethylstyryl)-2,4-diphenylpyryliumfluoroborate
(71c) 2-(4-ethylphenyl)-4,6-diphenylthiapyryliumperchlorate
(72c) 2,6-diphenyl-4-(4-methoxyphenyl)thiapyryliumperchlorate
(73c) 2,6-diphenyl-4-(4-methoxyphenyl)thiapyryliumfluoroborate
(74c) 2,6-bis(4-ethylphenyl)-4-(4-n-amyloxyphenyl)thiapyryliumpetchlorate
(75c) 2,5-bis(4-methoxyphenyl)-4-(4-n-amyloxyphenyl)thiapyryliumperchlorate
(76c) 2,4,6-tris(4-methoxyphenyl)thiapyryliumfluoroborate
(77c) 2,4-diphenyl-6-(3,4-diethoxystyryl)pyryliumperchlorate
(78c) 4-(4-dimethylaminophenyl)-2-phenylbenzo[b-]selenapyryliumperchlorate
(79c) 2-(2,4-dimethoxyphenyl)-4-(4-dimethylaminophenyl)benzo[b]selenapyryliumperchlorate
(80c) 4-(4-dimethylaminophenyl)-2,6-diphenylselenapyryliumperchlorate
(81c) 4-(4-dimethylaminophenyl)-2-(4-ethoxyphenyl)-6-phenylselenapyryliumperchlorate
(82c) 4-[4-bis(2-chloroethyl)aminophenyl]-2,6-diphenylselenapyryliumperehlorate
(83c) 4-(4-dimethylaminophenyl)-2,6-bis(4-ethylphenyl)selenapyryliumperchlorate
(84c) 4-(4-dimethylamino-2-methylphenyl)-2,6-diphenylselenapyryliumperchlorate
(85c) 3-(4-dimethylaminophenyl)naphto(2,1-b)selenapyryliumperchlorate
(86e) 4-(4-dimethylaminostyryl)-2-(4-methoxyphenyl)benzo[b]selenapyryliumperchlorate
(87c) 2,6-di(4-diethylaminophenyl)-4-phenylselenapyryliumperchlorate
(88c) 4-(4-dimethylaminophenyl)-2-(4-ethoxyphenyl)-6-phenylthiapyryliumfluoroborate A compound represented by the following general formula [VII] can be used as a charge generating material.

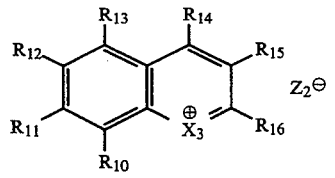

[VII]

In the formula [VII], $R_{10}$, $R_{11}$, $R_{12}$ and $R_{13}$ are respectively a hydrogen atom, a halogen atom such as chlorine and bromine, an alkyl group such as methyl, ethyl and propyl, an alkoxy group such as methoxy, ethoxy and propoxy or an aryl group such as phenyl, tolyl and thienyl. The alkyl group, the alkoxy group and the aryl group may have a substituent exemplified by an alkyl group, an alkoxy group, a halogen atom, a nitro group and disubstituted group.

$R_{14}$, $R_{15}$ and $R_{16}$ are respectively a hydrogen atom, a halogen atom, a hydroxy group, an alkyl group typically having from one to 20 carbon atoms, a substituted alkyl group, a mercapto group, a substituted mercapto group, a vinyl group, a substituted vinyl group, an aryl group such as phenyl and naphtyl, a substituted aryl group such as aminochlorophenyl, an alkenyl group having an alkenyl part having from two to six carbon atoms, such as ethenyl, propenyl, and hexenyl, a heterocyclic group having oxygen atom or sulfur atom as a hereto atom, aroyl group such as benzoyl and naphtoyl, an alkoxycarbonyl group having an alkoxy part having from one to four carbon atoms, such as methoxycarbonyl, propoxycarbonyl and butoxycarbonyl, a cycloalkyl group, an alkoxy group typically having from one to four carbon atoms, —$NHR_{17}$ or a substituted phenyl group represented by the following general formula;

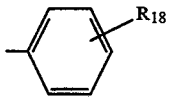

in which $R_{17}$ is an alkyl group typically having from one to 10 carbon atoms, such as methyl, isopropyl, n-butyl, pentyl, octyl and decyl, a cycloalkyl group such as cyclopentyl and cyclohexyl, an aralkyl group having an alkyl part typically having from one to four carbon atoms, such as benzyl, phenylethyl, phenylpropyl and phenylbutyl or an aryl group such as phenyl and naphtyl, and $R_{18}$ a is a hydrogen atom, a lower alkyl group typically having from one to four carbon atoms, such as methyl, ethyl, isopropyl and butyl, a lower alkyl group having an alkyl part typically having from one to four carbon atoms, such as methoxy, ethoxy, propoxy and butoxy.

In the formula [VII], $X_3$ is oxygen, sulfur or selenium. The compound represented by the formula [VII] of which $X_3$ is oxygen is benzopyrylium dye salts. The compound of which $X_3$ is sulfur is benzothiapyrylium dye salts. The compound of which $X_3$ is selenium is benzoselenapyrylium dye salts. $Z_2^-$ is an anionic functional group similar to $Z_1^-$.

Concrete compounds represented by the general formula [VII] are exemplified below;

(1d) 3-ethyl-2-(4-methoxyphenyl)benzo[b]pyryliumperchlorate
(2d) 2,3-diphenylbenzo[b]pyryliumperchlorate
(3d) 2-bromomethyl-3-phenylnaphto[2,1-b]pyryliumperchlorate
(4d) 2,3-diphenylbenzo[b]pyryliumperchlorate
(5d) 2-styrylbenzo[b]pyryliumperchlorate
(6d) 2-(4-methoxyphenyl)-4-methylmercaptobenzo[b-]pyryliumperchlorate
(7d) 4-methoxy-2-(4-methoxyphenyl)benzo[b]pyryliumperchlorate
(8d) 4-chloro-2-(4-methoxyphenyl)benzo[b]pyryliumperchlorate
(9d) 9-methylsantiliumperchlorate
(10d) 2-phenyl-4-styrylbenzo[b]pyryliumperchlorate
(11d) 4-methoxy-2-phenylbenzo[b]thiapyryliumperchlorate
(12d) 9-methylthiasantiliurnperchlorate
(13d) 2-chloro-3-phenylnaphto[2,1-b]pyryliumperchlorate
(14d) 10H-indeno[1,2-b]benzo[e]pyryliumperchlorate
(15d) 3-methyl-2-(4-methoxyphenyl)benzo[b]pyryliumfluoroborate
(16d) 2-phenylcarbonyl-3-phenylnaphto[2,1-b]pyryliumperchlorate
(17d) 2-hydroxy-3-phenylnaphto[2,1-b]pyryliumperchlorate
(18d) 2-phenylbenzo[b]pyryliumperchlorate
(19d) 4-benzylamino-2-phenylbenzo[b]pyryliumperchlorate
(20d) 4-anilino-2-(4-methoxyphenyl)naphto[1,2-b]pyryliumperchlorate
(21d) 1-[N-butylamino]-3-phenylnaphto[2,1-b]pyryliumperchlorate
(22d) 4-(N-butylamino)-2-(4-methoxyphenyl)naphto[1,2-b]pyryliumperchlorate
(23d) 1-anilino-3-phenylnaphto[2,1-b]pyryliumperchlorate
(24d) 4-N-butylamino-2-phenylbenzo[b]thiapyryliumperchlorate
(25d) 4-anilinoflavyliumperchlorate
(26d) 4-cyclohexylamino-2-phenylbenzo[b]thiapyryliumperchlorate
(27d) 4-N-octylamino-2-phenylbenzo[b]thiapyryliumperchlorate
(28d) 4-phenylamino-2-phenylbenzo[b]thiapyryliumperchlorate
(29d) 2-phenyl-4-phenethylaminobenzeno[b]thiapyryliumperchlorate
(30d) 4-N-butylamino-2-(p-methoxyphenyl)benzo[b-]pyryliumfluoroborate
(31d) 4-N-butylamino-2-(p-methoxyphenyl)benzo[b-]pyryliumperchlorate The compound represented by the general formula [II], [III], [IV], [V], [VI] or [VII] may be mixed with another charge generating materials such as selenium, selenium-tellurium, amorphous silicon, pyrylium salts, azo pigments, bisazo pigments, phthalocyanine pigments, anthanthron compounds, perylene pigments, indigo compounds, triphenylmethane compounds, threne compounds, toluidine compounds, pyrazoline compounds and quinacridone compounds.

A photosensitive member has a photosensitive layer comprising the compound represented by the general formula [II], [III], [IV], [V], [VI] or [VII] as a charge generating material and the amino compound represented by the general formula [I] as a charge transporting material.

The compound represented by the general formula [II], [III], [IV], [V], [VI] or [VII] generates charges with very high efficiency by absorbing light, and the generated charges are effectively transported with the amino compound of [I], resulting in the improvement of sensitivity of a photosensitive member.

The binder resins used for forming a photosensitive layer are exemplified with no significance in restricting the embodiments of the invention by thermoplastic resins such as saturated polyesters, polyamides, acrylic resins, ethylene-vinyl acetate copolymers, ion cross-linked olefin copolymers (ionomer), styrene-butadiene block copolymers, polycarbonates, vinyl chloride-vinyl acetate copolymers, cellulose esters, polyimides and styrols: thermosetting resins such as epoxy resins, silicone resins, phenolic resins, melamine resins, alkyd resins and thermosetting acrylic resins; photocuring resins; and photoconductive resins such as poly-N-vinyl carbazole, polyvinyl pyrene, polyvinyl anthracene, polyvinylpyrrole, all named without any significance of restricting the use of them. Any of these resins can be used singly or in combination with other resins. It is desirable for any of these electrically insulative resins to have a volume resistance of $1\times10^{12}$ Ω· cm or more when measured singly.

As to the binder resins, polycarbonates represented by the following general formula [VII] is effective in improving durability and stability of a coating solution.

[VIII]

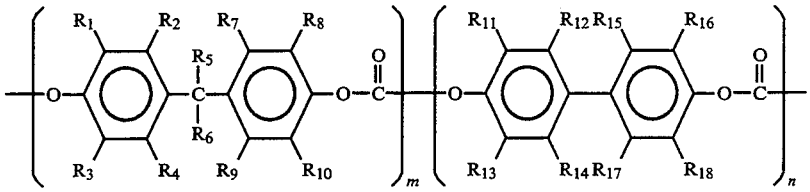

In the general formula [VIII], $R_1$, $R_2$, $R_3$, $R_4$, $R_7$, $R_8$, $R_9$ and $R_{10}$ represent respectively a hydrogen atom, an alkyl group such as methyl, ethyl and propyl, an aryl group such as phenyl and naphthyl or a halogen atom such as chlorine and bromine. $R_5$ and $R_6$ represent respectively a hydrogen atom, an alkyl group such as methyl, ethyl, propyl, buthyl and penthyl, cycloalkyl group such as cyclohexyl and norbornane ring, an aryl group such as phenyl and naphthyl. $R_5$, $R_6$ and a carbon atom may form a ring in combination such as cyclohexane ring, norbornane ring and fluorene ring. The small letter m is an integer of 0–500. The small letter n is an integer of 5–100. The m:n is 9:1–1:9, preferably 9:1–1:1.

$R_{11}$, $R_{12}$, $R_{13}$, $R_{14}$, $R_{15}$, $R_{16}$, $R_{17}$ and $R_{18}$ represent respectively a hydrogen atom, an alkyl group such as methyl, ethyl and propyl, an aryl group such as phenyl and naphthyl or a halogen atom such as bromine atom and chlorine atom.

It is preferable that the polycarbonate having a number average molecular weight of $1\times10^4$ to $1\times10^5$, preferably $2\times10^4$ to $8\times10^4$, more preferably $4\times10^4$ to $6.5\times10^4$ is used as the binder resin from the view points of durability and coatability.

Concrete polycarbonate resins represented by the general formula [VII] are exemplified as shown below:

(1)

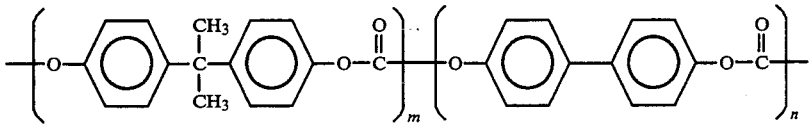

(2)

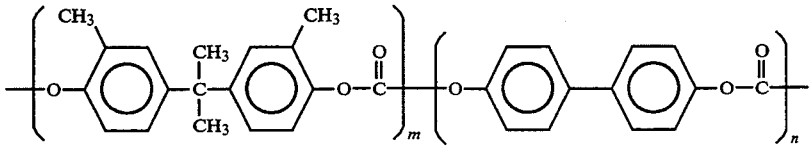

(3)

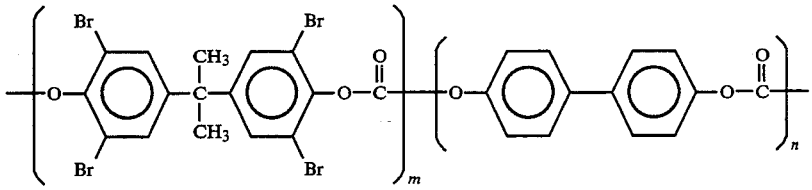

(4)

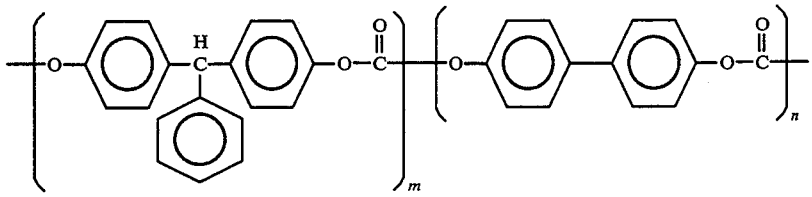

(5)

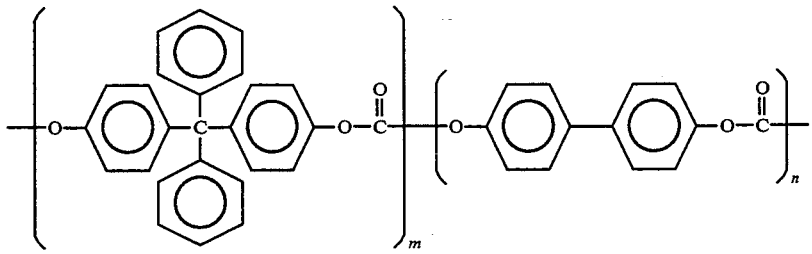

-continued
(6)
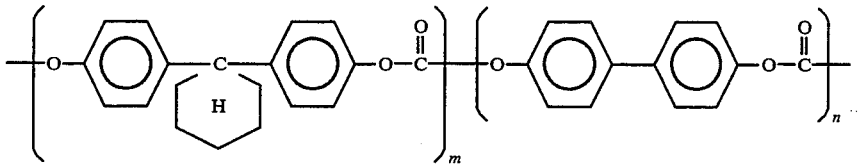
(7)
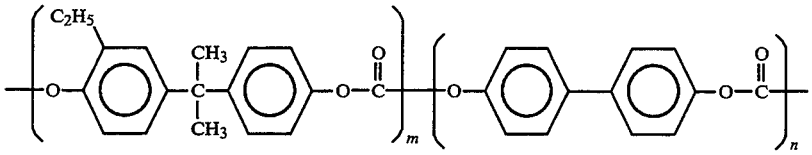
(8)
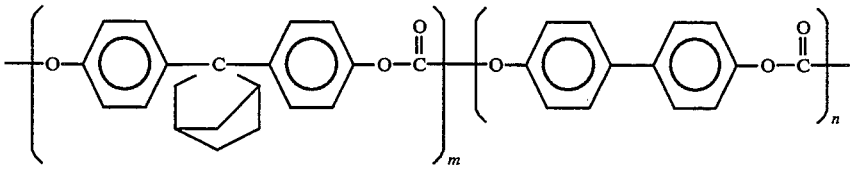
(9)
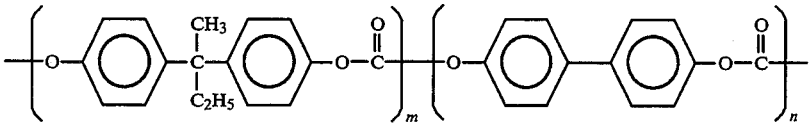
(10)
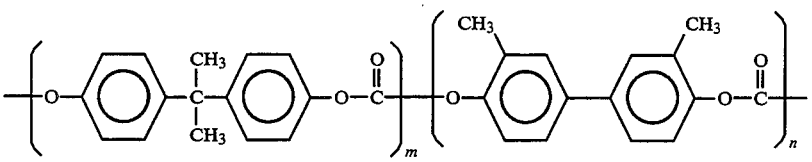
(11)
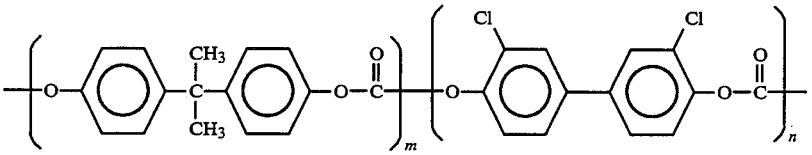
(12)
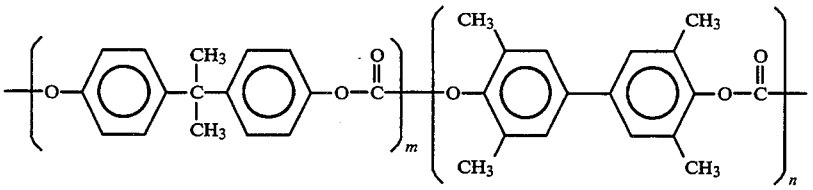
(13)
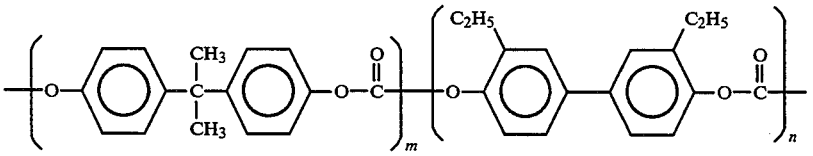
(14)
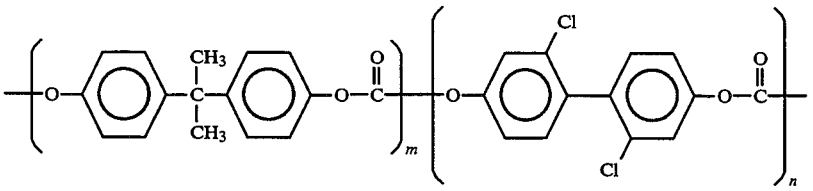

-continued (15)

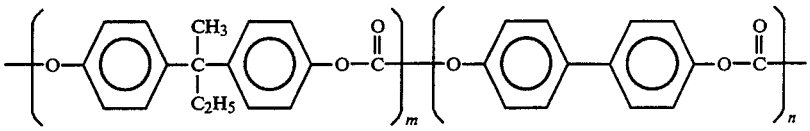

(16)

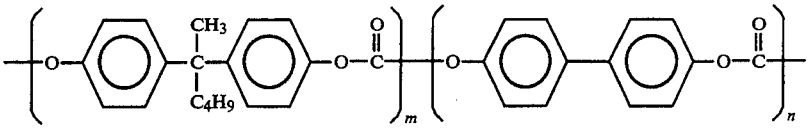

(17)

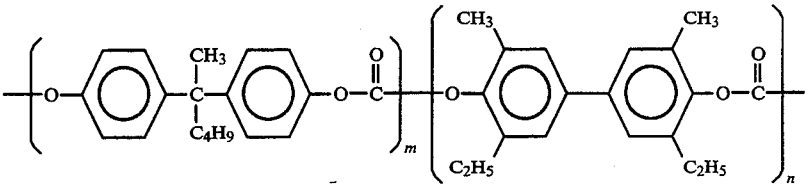

(18)

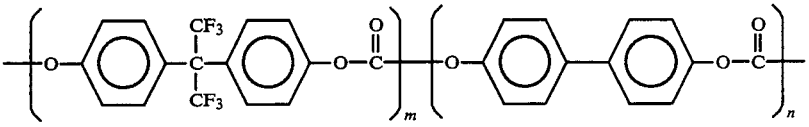

In order to form a photosensitive member of a monolayer type, fine particles of a charge generating material are dispersed in a resin solution or a solution containing a charge transporting material and a binder resin and then the solution is sprayed on an electrically conductive substrate followed by drying. A thickness of the photosensitive layer is 3—30 μm, preferably 5–20 μm. The sensitivity becomes poor if the charge generating material is used in an insufficient quantity, whereas the chargeability becomes poor and the mechanical strength of photosensitive layer is inadequate if used to excess. Therefore, the amount of the charge generating material is within the range of 0.01–2 parts by weight, preferably 0.2–1.2 parts by weight on the basis of one part by weight of the binder resin of the photosensitive layer.

In order to form a photosensitive member of a laminated type, a charge generating material is deposited in a vacuum on an electrically conductive substrate, a charge generating material is dissolved in a solvent such as amine-containing solvent to apply onto an electrically conductive substrate or an application solution containing a charge transporting material and, if necessary, a binder resin dissolved in an appropriate solvent is applied onto an electrically conductive substrate to be dried, for the formation of a charge generating layer on an electrically conductive substrate. Then, a solution containing a charge transporting material and a binder resin is applied onto the charge generating layer following by drying for the formation of a charge transporting layer. A thickness of the charge generating layer is 4 μm or less, preferably 2 μm or less. A thickness of the charge transporting layer is 3–50 μm, preferably 5–30 μm. A ratio of the charge transporting material in the charge transporting layer is 0.2–2 parts by weight, preferably 0.3–1.3 parts by weight on the basis of one part by weight of the binder resin.

A photosensitive member of the present invention permits, in combination with the binder, the use of a plasticizer such as halogenated paraffin, polybiphenyl chloride, dimethyl naphthalene, dibutyl phthalate and o-terphenyl, the use of an electron-attracting sensitizer such as chloranyl, tetracyanoethylene, 2,4,7-trinitrofluorenone, 5,6-dicyanobenzoquinone, tetracyanoquinodimethane, tetrachlorophthalic anhydride and 3,5-dinitrobenzoic acid, or the use of a sensitizer such as methyl violet, rhodamine B, cyanine dye, pyrylium salt and thiapyrylium salt.

An electrically conductive substrate is exemplified by a sheet or a drum made of metal or alloy such as copper, aluminium, silver, iron and nickel; a substrate such as a plastic film on which the foregoing metal or alloy is adhered by a vacuum-deposition method or an electroless plating method and the like; substrate such as a plastic film and paper on which an electroconductive layer is formed by applying or depositing electroconductive polymer, indium oxide, tin oxide etc.

Concrete constitutions of a photosensitive member are shown in FIG. 1 to FIG. 5.

FIG. 1 shows a monolayer type in which a photosensitive layer (4) containing a charge generating material (3) and a charge transporting material (2) dispersed in a binder resin is formed on an electrically conductive substrate. The amino compound of the present invention is used as the charge transporting material.

Figure 2:
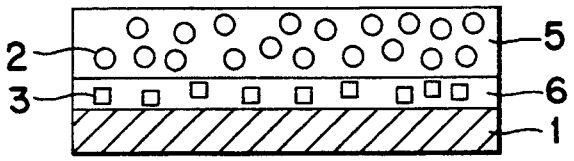
FIG. 2 is a schematic sectional view of a function-divided photosensitive member having a charge generating layer and a charge transporting layer on an electrically conductive substrate in this order.

FIG. 2 is a function-divided type in which a photosensitive layer is composed of a charge generating layer (6) and a charge transporting layer (5). The charge transporting layer (5) is formed on the surface of the charge generating layer (6). The amino compound of the present invention is incorporated into the charge transporting layer (5).

Figure 3:
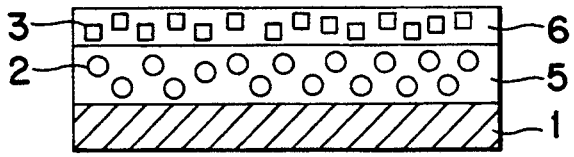
FIG. 3 is a schematic sectional view of a function-divided photosensitive member having a charge transporting layer and a charge generating layer on an electrically conductive substrate in this order.

A photosensitive member shown in FIG. 3 is similar to that of FIG. 2 in a function-divided type having a charge generating layer (6) and a charge transporting layer (5), but different in that the charge generating layer (6) is formed on the surface of the charge transporting layer (5).

Figure 4:
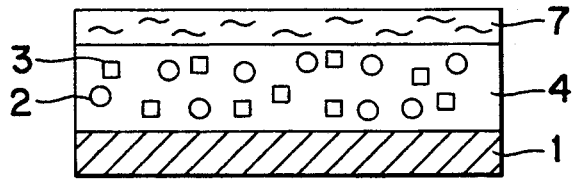
FIG. 4 is a schematic sectional view of a photosensitive member having a photosensitive layer and a surface protective layer on an electrically conductive substrate in this order.

A photosensitive member shown in FIG. 4 has further a surface protective layer (7) formed on the photosensitive member of FIG. 1. The photosensitive layer (4) may be a function divided type having a charge generating layer (6) and a charge transporting layer (5).

Figure 5:
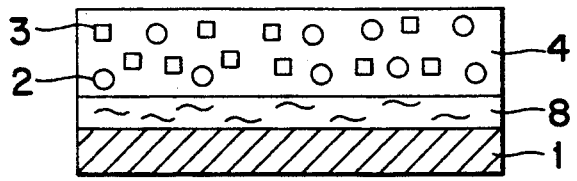
FIG. 5 is a schematic sectional view of a photosensitive member having an intermediate layer and a photosensitive layer on an electrically conductive substrate in this order.

A photosensitive member shown in FIG. 5 has an intermediate layer between a substrate (1) and a photosensitive layer (4). The photosensitive layer (4) may be a function divided type having a charge generating layer (6) and a charge transporting layer (5). The intermediate layer is effective in improvement of adhesivity, improvement of coatability, protection of the substrate, improvement of charge injection from the substrate into the photosensitive layer.

Materials used for the formation of the intermediate layer is exemplified by polyimides, polyamides, nitrocelluloses, polyvinylbutyrals, polyvinyl alcohols and aluminium oxides. It is desirable that a thickness of the intermediate layer is 1 μm or less.

Synthetic Example of the amino compound (2)

4-iodobiphenyl-4'-p-iodobenzyl of 50 g (0.01 mole), 3-methyldiphenylamine of 44 g (0.24 mole), potassium carbonate of 35 g (0.3 mole), copper powder of 10 g (0.16 mole) and nitrobenzene of 400 g were placed in a four-necked flask of 1 liter capacity with a reflex condenser to be treated for 18 hours at 200° C. under nitrogen stream. After reaction, tetrahydrofuran of 200 g was added to the reaction solution and solids were filtrated. The filtrate was subjected to silica gel column chromatography. The separated products were purified by recrystallization from toluene-ethanol solvent to give white crystals having a melting point of 75°–76° C. The result of elemental analysis of the resultant ($C_{45}H_{38}N_2$) is shown below:

| | C (%) | H (%) | N (%) |
|---|---|---|---|
| calculated | 89.11 | 6.27 | 4.62 |
| found | 89.06 | 6.24 | 4.60 |

EXAMPLE 1

The azo compound of 0.45 parts represented by the following formula [a] below:

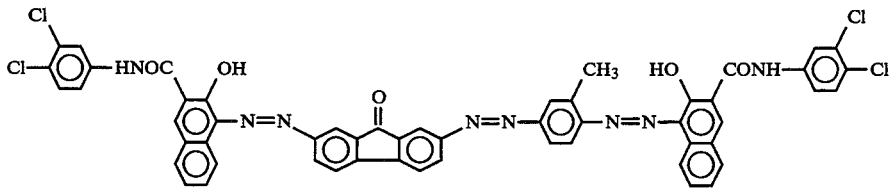

[a]

polyvinylbutyral resin (S-Lec BM-3; made by Sekisui Kagaku Kogyo K.K.) of 0.45 parts and cyclohexanone of 50 parts were placed in Sand mill for dispersion. The dispersion solution of the azo compound was applied onto alumino type-Mylar of 100 micron thickness by film applicator to form a charge generating layer so that the thickness of dried layer would be 0.3 g/m$^2$.

A solution containing the amino compound [11] of 70 parts and polycarbonate resin (Panlite K-1300; made by Teijin Kasei K.K.) of 70 parts dissolved in 1,4-dioxane of 400 parts was applied onto the charge generating layer to form a charge transporting layer so that the thickness of dried layer would be 20 microns. Thus, a photosensitive member with two layers was prepared.

EXAMPLES 2–10

Photosensitive members were prepared in a manner similar to Example 1 except that the azo compound represented by the general formula [III] having such $R_9$, $R_{10}$, $R_6$, $Ar_7$ and $Cp_2$ that shown in Table 1 were used and that amino compounds shown in Table 1 were used respectively instead of the amino compound [11].

The number of $Cp_2$ and $Ar_7$ shown in Table 1 corresponds to the number of the chemical formula of couplers exemplified above.

TABLE 1

| | $R_9$ | $R_{10}$ | $Ar_6$ | $Ar_7$ | $Cp_2$ | amino compound |
|---|---|---|---|---|---|---|
| Example 2 | H | H | 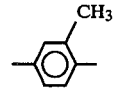 | 10 | 10 | 12 |
| Example 3 | 3-Cl | 6-Cl | 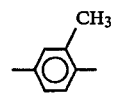 | 25 | 25 | 25 |
| Example 4 | H | H | 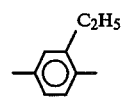 | 31 | 31 | 31 |
| Example 5 | 3-Br | 6-Br | 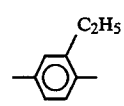 | 35 | 35 | 38 |
| Example 6 | H | H | 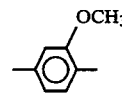 | 37 | 37 | 46 |
| Example 7 | H | 3-Br | 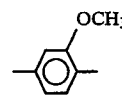 | 44 | 44 | 63 |
| Example 8 | H | H | 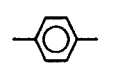 | 45 | 45 | 72 |
| Example 9 | H | H | 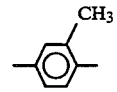 | 44 | 44 | 88 |
| Example 10 | 3-$CH_3$ | H | 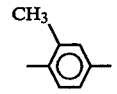 | 32 | 32 | 92 |

EXAMPLE 11

The azo compound of 0.45 parts represented by the following formula [b] below:

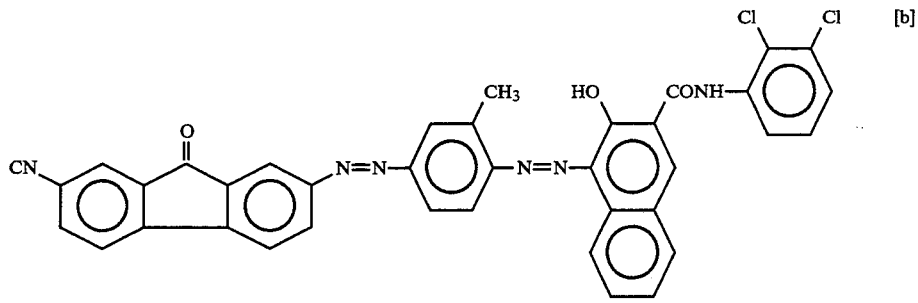

polyvinylbutyral resin (S-Lec BX-1; made by Sekisui Kagaku Kogyo K.K.) of 0.45 parts and cyclohexanone of 50 parts were placed in Sand mill for dispersion. The dispersion solution of the azo compound was applied onto alumino type-Mylar of 100 micron thickness by film applicator to form a charge generating layer so that the thickness of dried layer would be 0.4 g/m$^2$.

A solution containing the amino compound [11] of 70 parts and polycarbonate resin (Z-200; made by Mitsubishi Gas Kagaku K.K.) of 100 parts dissolved in dichloromethane of 1000 parts was applied onto the charge generating layer to form a charge transporting layer so that the thickness of dried layer would be 24 microns. Thus, a photosensitive member with two layers was prepared.

EXAMPLES 12–20

Photosensitive members were prepared in a manner similar to Example 11 except that the azo compound represented by the general formula [II] having such $R_9$,$R_{10}$, $Ar_5$ and $Cp_1$ that shown in Table 2 were used and that amino compounds shown in Table 2 were used respectively instead of the amino compound [11 ].

The number of $Cp_1$ shown in Table 2 corresponds to the number of the chemical formula of couplers exemplified above.

TABLE 2

| | $R_9$ | $R_{10}$ | $Ar_5$ | $Cp_1$ | amino compound |
|---|---|---|---|---|---|
| Example 12 | 7-$NH_2$ | H | 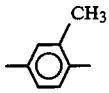 | 44 | 3 |
| Example 13 | 3-Br | 6-Br | 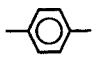 | 10 | 10 |
| Example 14 | 7-OH | H | 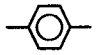 | 25 | 12 |

TABLE 2-continued

| | $R_9$ | $R_{10}$ | $Ar_5$ | $Cp_1$ | amino compound |
|---|---|---|---|---|---|
| Example 15 | 7-OH | H | 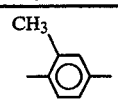 | 5 | 16 |
| Example 16 | 3-Cl | 6-Cl | 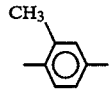 | 16 | 25 |
| Example 17 | 7-$NO_2$ | H | 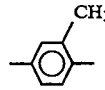 | 27 | 37 |
| Example 18 | 7-$NO_2$ | H | 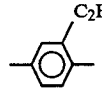 | 35 | 45 |
| Example 19 | H | H | 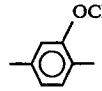 | 36 | 63 |
| Example 20 | 7-$OCH_3$ | H | 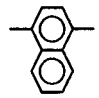 | 42 | 72 |

EXAMPLE 21

The azo compound of 1 part represented by the following formula [c] below:

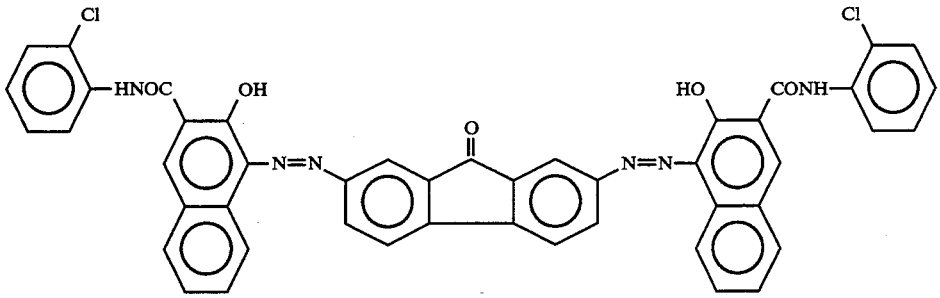

polyester resin (Vylon 200; made by Toyoho K.K.) of 1 part and cyclohexanone of 100 parts were placed in Sand mill for dispersion. The dispersion solution of the azo compound was applied onto an aluminum drum (outer diameter:80 mm) to form a charge generating layer so that the thickness of dried layer would be 0.3 g/m$^2$.

A solution containing the amino compound [11] of 70 parts and polycarbonate resin (C-1400; made by Teijin Kasei K.K.) of 70 parts dissolved in tetrahydrofuran of 500 parts was applied onto the charge generating layer to form a charge transporting layer so that the thickness of dried layer would be 25 microns. Thus, a photosensitive member with two layers was prepared.

EXAMPLES 22–30

Photosensitive members were prepared in a manner similar to Example 21 except that the azo compound represented by the general formula [IV] having such $R_9$, $R_{10}$, $Cp_3$ and $Cp_4$ that shown in Table 3 were used and that amino compounds shown in Table 3 were used respectively instead of the amino compound [11].

The number of $Cp_3$ and $Cp_4$ shown in Table 3 corresponds to the number of the chemical formula of couplers exemplified above.

TABLE 3

| | $R_9$ | $R_{10}$ | $Cp_3$ | $Cp_4$ | amino compound |
|---|---|---|---|---|---|
| Example 22 | H | H | 31 | 31 | 3 |
| Example 23 | H | H | 44 | 44 | 10 |
| Example 24 | H | H | 2 | 32 | 12 |
| Example 25 | H | H | 44 | 25 | 16 |
| Example 26 | H | H | 45 | 10 | 25 |
| Example 27 | 3-Br | 6-Br | 2 | 2 | 37 |
| Example 28 | 3-Br | 6-Br | 35 | 35 | 45 |
| Example 29 | 3-Cl | H | 31 | 8 | 63 |
| Example 30 | 3-Cl | H | 42 | 42 | 72 |

Comparative Examples 1–5

Photosensitive members were prepared in a manner similar to Example 1 except that the amino compounds represented by the following formulas [d], [e], [f], [g] and [h] were used instead of the amino compound [11].

[d]

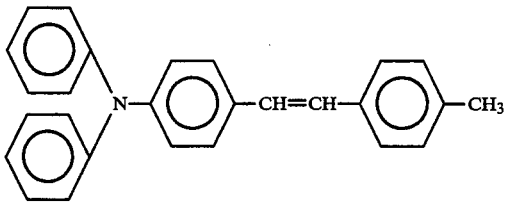

-continued

[e]

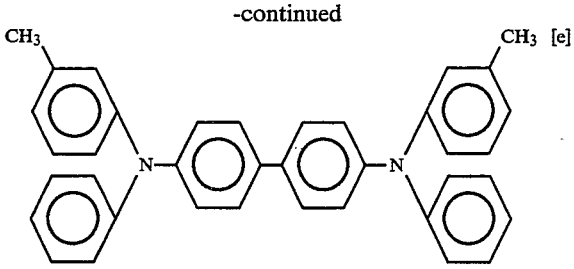

[f]

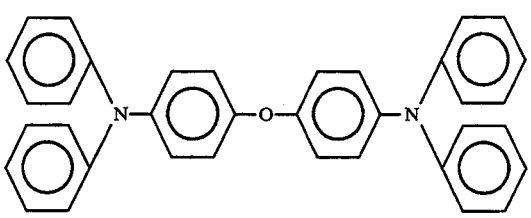

[g]

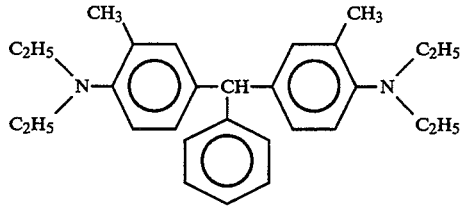

[h]

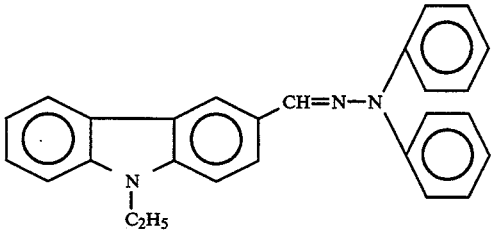

EXAMPLE 31

The azo compound of 0.1 parts represented by the following formula [i], the azo compound of 0.9 parts represented by the above formula [a];

[i]

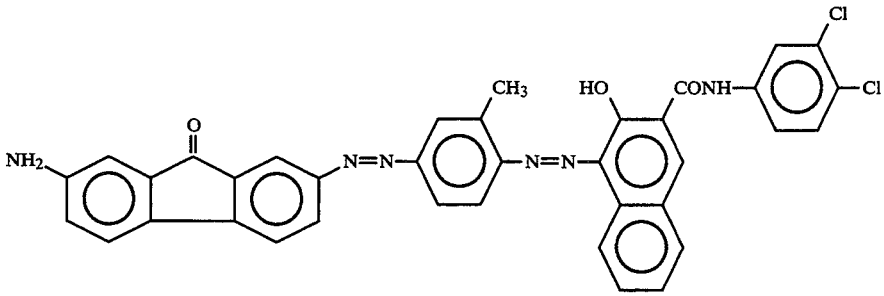

polyvinylbutyral resin (S-Lec BM-3; made by Sekisui Kagaku Kogyo K.K.) of 1 parts and cyclohexanone of 100 parts were placed in Sand mill for dispersion. The dispersion solution of the azo compounds were applied onto aluminotype-Mylar of 100 micron thickness by film applicator to form a charge generating layer so that the thickness of dried layer would be 0.3 g/m$^2$.

The charge transporting layer was prepared in a manner similar to Example 1 onto the charge generating layer. Thus, a photosensitive member with two layers was prepared.

EXAMPLES 32

Photosensitive member was prepared in a manner similar to Example 31 except that the above azo compound [a] of 0.9 parts and the azo compound of 0.1 parts represented by the following formula [j] were used respectively instead of the azo compounds [a] and [i].

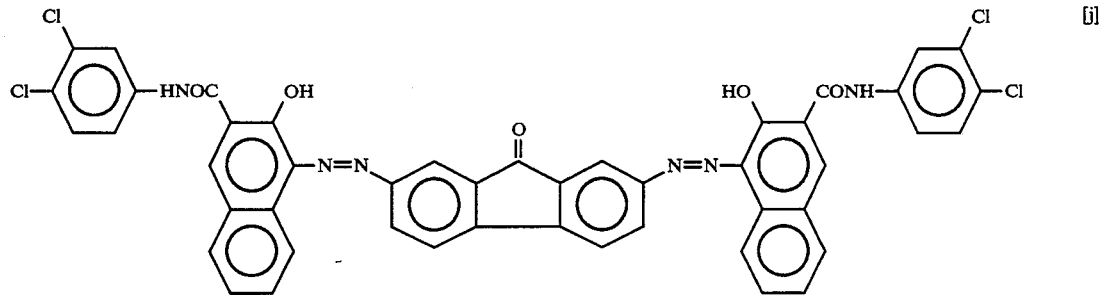

[j]

EXAMPLES 33

Photosensitive member was prepared in a manner similar to Example 31 except that the above azo compound [i] of 0.1 parts, the above azo compound [a] of 0.8 parts and the above azo compound [j] of 0.1parts were used respectively instead of the azo compounds [a] and [i].

The resultant photosensitive members were installed in an copying machine (EP-470Z; made by Minolta Camera K.K.) and corona-charged by power of −6 KV level to evaluate initial surface potential $V_o$ (V), half-reducing amount ($E_{\frac{1}{2}}$ (lux.sec) ) and dark decreasing ratio of the initial surface potential ($DDR_1$). $E_{\frac{1}{2}}$ means an exposure amount required to reduce the initial potential to half the value. $DDR_1$ is a decreasing ratio of the initial surface potential after the photosensitive member was left for 1 second in the dark.

The results of $V_o$, $E_{\frac{1}{2}}$ and $DDR_1$ with respect to the photosensitive members obtained Examples 1–33 and Comparative Examples 1–5 were summarized in Table 4 below.

TABLE 4

| | $V_0$ (V) | $E_{\frac{1}{2}}$ (lux · sec) | $DDR_1$ (%) |
|---|---|---|---|
| Example 1 | −660 | 0.6 | 2.5 |
| Example 2 | −660 | 0.7 | 2.6 |
| Example 3 | −670 | 0.7 | 2.3 |
| Example 4 | −660 | 0.8 | 2.6 |
| Example 5 | −650 | 0.6 | 3.0 |
| Example 6 | −660 | 0.8 | 2.7 |
| Example 7 | −650 | 0.6 | 2.9 |
| Example 8 | −660 | 0.6 | 2.7 |
| Example 9 | −670 | 0.8 | 2.4 |
| Example 10 | −660 | 0.7 | 2.6 |
| Example 11 | −660 | 1.0 | 2.5 |
| Example 12 | −660 | 0.9 | 2.6 |
| Example 13 | −670 | 1.1 | 2.3 |
| Example 14 | −660 | 0.8 | 2.6 |
| Example 15 | −650 | 0.9 | 3.1 |
| Example 16 | −660 | 1.2 | 2.5 |
| Example 17 | −660 | 1.0 | 2.7 |
| Example 18 | −670 | 0.9 | 2.3 |
| Example 19 | −660 | 1.0 | 2.6 |
| Example 20 | −650 | 1.2 | 3.0 |
| Example 21 | −660 | 0.9 | 2.4 |
| Example 22 | −670 | 1.0 | 2.1 |
| Example 23 | −660 | 0.8 | 2.5 |
| Example 24 | −670 | 0.9 | 2.3 |
| Example 25 | −660 | 1.0 | 2.6 |
| Example 26 | −660 | 0.9 | 2.4 |
| Example 27 | −660 | 1.0 | 2.5 |
| Example 28 | −650 | 0.8 | 2.9 |
| Example 29 | −660 | 1.0 | 2.7 |
| Example 30 | −670 | 1.1 | 2.1 |
| Example 31 | −660 | 0.7 | 2.4 |
| Example 32 | −660 | 0.6 | 2.5 |
| Example 33 | −650 | 0.6 | 2.8 |
| Comp. Example 1 | −670 | 3.0 | 2.1 |
| Comp. Example 2 | −660 | 2.4 | 2.7 |
| Comp. Example 3 | −670 | 7.9 | 2.0 |
| Comp. Example 4 | −670 | 6.5 | 2.3 |
| Comp. Example 5 | −660 | 2.8 | 2.5 |

EXAMPLE 34

A solution containing polyamide resin (CM8000; made by Tore K.K.) of 1 part dissolved in mixture of methanol of 40 parts and n-butanol of 40 parts was applied onto aluminum substrate to form a under coating layer so that the thickness of dried layer would be 0.1 micron.

1,4-dithioketo-3,6-diphenylpyrrolo[3,4-c]pyrrole of 1 part, the amino compound [10] of 10 parts, polycarbonate resin (Panlite K-1300; made by Teijin Kasei K.K.) of 10 parts and dichloroethane of 100 parts were placed in Sand mill for dispersion for 2 hours. The dispersion solution was applied onto the under coating layer to form a photoconductive layer so that the thickness of dried layer would be 15 microns. Thus, a photosensitive member with one layer was prepared.

EXAMPLES 35–37

Photosensitive members were prepared in a manner similar to Example 34 except that the amino compounds [12], [14] and [20] were used instead of the amino compound [10].

EXAMPLE 38

A solution containing polyvinylbutyral resin (BX-1; made by Sekisui Kagaku Kogyo K.K.) of 1 part dissolved in tetrahydrofuran of 80 parts was applied onto aluminum substrate to form a under coating layer so that the thickness of dried layer would be 0.1 micron.

Thiapyrylium dye salt (2c) of 0.5 part, the amino compound [4] of 10 parts and polycarbonate resin (Panlite K-1300; made by Teijin Kasei K.K.) of 10 parts were dissolved in dichloromethane of 100 parts.

The solution was applied onto the under coating layer to form a photoconductive layer so that the thickness of dried layer would be 15 microns. Thus, a photosensitive member with one layer was prepared.

EXAMPLES 39–41

Photosensitive members were prepared in a manner similar to Example 38 except that the amino compounds [16], [36] and [39] were used instead of the amino compound [4].

EXAMPLE 42

A solution containing N-methoxymethylnylon (TorejinF30; made by Ieikoku Kagaku K.K.) of 1 part dissolved in methanol 90 parts was applied onto aluminum drum to form a under coating layer so that the thickness of dried layer would be 0.5 micron.

Benzothiapyrylium salt (11d) of 1 part and polycarbonate resin (Panlite K-1300; made by Teijin Kasei K.K.) of 10 parts were dissolved in dichloromethane of 400 parts.

The solution was applied onto the under coating layer to form a charge generating layer so that the thickness of dried layer would be 0.8 microns.

A solution containing the amino compound [50] of 50 parts and polycarbonate resin (Z-300; made by Mitsubishi Gas Kagaku K.K.) of 50 parts dissolved in tetrahydrofuran of 400 parts was applied onto the charge generating layer to form a charge transporting layer so that the thickness of dried layer would be 20 microns. Thus, a photosensitive member with two layers was prepared.

EXAMPLES 43–44

Photosensitive members were prepared in a manner similar to Example 42 except that the amino compounds [62] and [92] were used instead of the amino compound [50 ].

Comparative Examples 6–9

Photosensitive members were prepared in a manner similar to Example 38 except that the above compound [g], the following compounds [k], [l] and [m] were used instead of the amino compound [4].

[k]

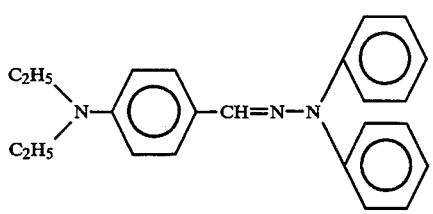

[l]

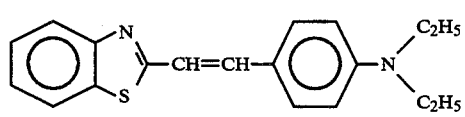

[m]

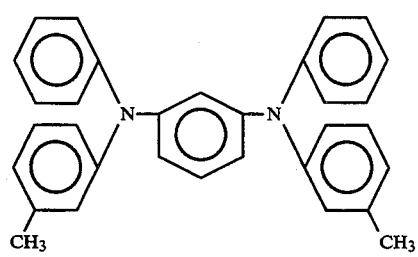

The resultant photosensitive members obtained. Examples 34–41 and Comparative Examples 6–9 were installed in an copying machine (EP-350Z; made by Minolta Camera K.K.) and corona-charged by power of +6 KV level to evaluate initial Surface potential $V_o$ (V), half-reducing amount ($E_{\frac{1}{2}}$ (lux.sec)) and dark decreasing ratio of the initial surface potential ($DDR_1$). The results of $V_o$, $E_{\frac{1}{2}}$ and $DDR_1$ with respect to the photosensitive members were summarized in Table 5 below.

The resultant photosensitive members obtained Examples 38–44 were installed in an copying machine (EP-made 3120; by Minolta Camera K.K.) and corona-charged by power of −6 KV level to evaluate initial surface potential $V_o$(V), half-reducing amount ($E_{\frac{1}{2}}$ (lux.sec)) and dark decreasing ratio of the initial surface potential ($DDR_1$). The results of $V_o$, $E_{\frac{1}{2}}$ and $DDR_1$ with respect to the photosensitive members were summarized in Table 5 below.

TABLE 5

| | $V_0$ (V) | $E_{\frac{1}{2}}$ (lux · sec) | $DDR_1$ (%) |
|---|---|---|---|
| Example 34 | +591 | 1.9 | 2.0 |
| Example 35 | +602 | 1.2 | 2.3 |
| Example 36 | +595 | 1.5 | 1.8 |
| Example 37 | +597 | 1.3 | 1.7 |
| Example 38 | +586/−605 | 1.7/2.2 | 1.6/0.7 |
| Example 39 | +593/−607 | 1.2/2.1 | 1.4/0.6 |
| Example 40 | +596/−598 | 1.3/2.4 | 2.0/0.5 |
| Example 41 | +582/−595 | 1.5/2.3 | 2.7/0.8 |
| Example 42 | −610 | 1.8 | 2.1 |
| Example 43 | −608 | 2.0 | 2.5 |
| Example 44 | −605 | 1.9 | 2.3 |
| Comp. Example 6 | +592 | 4.5 | 1.9 |
| Comp. Example 7 | +598 | 7.3 | 1.7 |
| Comp. Example 8 | +601 | 9.2 | 1.3 |
| Comp. Example 9 | +597 | 4.1 | 2.4 |

EXAMPLE 45

The charge generating layer was prepared in a manner similar to Example 1 except that the azo compound [c] was used instead of the azo compound [a] and polyester resin (Vylon made by Toyobo K.K.) was used instead of polyvinylbutyral resin.

A solution containing the amino compound [3] of 50 parts and polycarbonate resin [1] (in which n and m are about 100) of 70 parts dissolved in mixture of 1,4-dioxane of 400 parts and cyclohexanone of 100 parts was applied onto the charge generating layer to form a charge transporting layer so that the thickness of dried layer would be 20 microns. Thus, a photosensitive member with two layers was prepared.

EXAMPLES 46–49

Photosensitive members were prepared in a manner similar to Example 45 except that the amino compounds [5], [7], [10] and [11] were used respectively instead of the amino compound [3].

EXAMPLE 50

The charge generating layer was prepared in a manner similar to Example 1 except that the azo compound [n] was used instead of the azo compound [a].

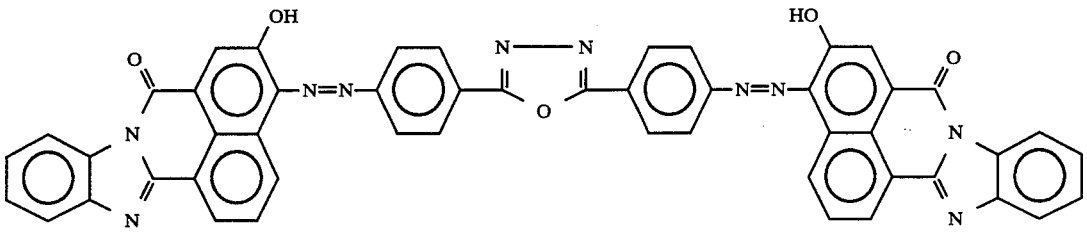

[n]

A solution containing the amino compound [12] of 40 parts and polycarbonate resin [2] (in which n is about 50 and m is about 100) of 60 parts dissolved in 1,4-dioxane of 500 parts was applied onto the charge generating layer to form a charge transporting layer so that the thickness of dried layer would be 20 microns. Thus, a photosensitive member with two layers was prepared.

EXAMPLES 51–54

Photosensitive members were prepared in a manner similar to Example 50 except that the amino compounds [16], [17], [18] and [20] were used respectively instead of the amino compound [12].

EXAMPLE 55

The $\tau$-form metal free phthalocyanine of 0.1 part, polyvinylbutyral resin of 0.5 parts and tetrahydrofuran of 50 parts were placed in Sand mill for dispersion. The dispersion solution was applied onto aluminotype-Mylar of 100 micron thickness by film applicator to form a charge generating layer so that the thickness of dried layer would be 0.2 g/m$^2$.

A solution containing the amino compound [25] of 40 parts and polycarbonate resin [5] (in which n is about 20 and m is about 80) of 60 parts dissolved in dichloroethane of 500 parts was applied onto the charge generating layer to form a charge transporting layer so that the thickness of dried layer would be 25 microns. Thus, a photosensitive member with two layers was prepared.

EXAMPLES 56–59

Photosensitive members were prepared in a manner similar to Example 55 except that the amino compounds [28], [30], [31] and [36] were used respectively instead of the amino compound [25].

EXAMPLE 60

The titanylphthalocyanine of 0.5 part, phenoxy resin of 0.2 parts, polyvinylbutyral resin of 0.3 parts and cyclohexanone of 50 parts were placed in Sand mill for dispersion. The dispersion solution was applied onto aluminotype-Mylar of 100 micron thickness by film applicator to form a charge generating layer so that the thickness of dried layer would be 0.25 g/m$^2$.

A solution containing the amino compound [38] of 70 parts, polycarbonate resin [9] (in which the ratio of n:m is 1:1 and molecular weight is about 24,000) of 25 parts and polycarbonate resin [9] (in which m is zero and molecular weight is about 45,000) of 45 parts dissolved in mixture of 1,4-dioxane of 400 parts and cyclohexanone of 100 parts was applied onto the charge generating layer to form a charge transporting layer so that the thickness of dried layer would be 20 microns. Thus, a photosensitive member with two layers was prepared.

EXAMPLES 61–64

Photosensitive members were prepared in a manner similar to Example 60 except that the amino compounds [39], [45], [48] and [49] were used respectively instead of the amino compound [38].

EXAMPLE 65

The dibromoansanthron of 0.5 parts, polyvinylbutyral resin of 0.5 parts and cyclohexanone of 50 parts were-placed in Sand mill for dispersion. The dispersion solution was applied onto aluminotype-Mylar of 100 micron thickness by film applicator to form a charge generating layer so that the thickness of dried. layer would be 0.8 g/m$^2$.

A solution containing the amino compound [50] of 40 parts and polycarbonate resin [6] (in which the ratio of n:m is 1:1 and molecular weight is about 40,000) of 50 parts dissolved in tetrahydrofuran of 500 parts was applied onto the charge generating layer to form a charge transporting layer so that the thickness of dried layer would be 20 microns. Thus, a photosensitive member with two layers was prepared.

EXAMPLES 66–69

Photosensitive members were prepared in a manner similar to Example 65 except that the amino compounds [51], [57], [61] and [63] were used respectively instead of the amino compound [50 ].

EXAMPLE 70

The charge generating layer was prepared in a manner similar to Example 45.

A solution containing the amino compound [68] of 30 parts, polycarbonate resin [1] (in which the ratio of m:n is 4:1 and molecular weight is about 40,000) of 50 parts and polymethylmethacrylate (BR-85; made by Mitsubishi raiyon K.K.) of 20 parts dissolved in tetrahydrofuran of 500 parts was applied onto the charge generating layer to form a charge transporting layer so that the thickness of dried layer would be 20 microns. Thus, a photosensitive member with two layers was prepared.

EXAMPLE 71

The charge generating layer was prepared in a manner similar to Example 45.

A solution containing the amino compound [10] of 40 parts, polycarbonate resin [5] (in which the ratio of m:n is 1:1 and molecular weight is about 40,000) of 60 parts and polyester resin (Vylon 200; made by Toyoho K.K.) of 10 parts dissolved in tetrahydrofuran of 500 parts was applied onto the charge generating layer to form a charge transporting layer so that the thickness of dried layer would be 20 microns. Thus, a photosensitive member with two layers was prepared.

EXAMPLE 72

The charge generating layer was prepared in a manner similar to Example 45.

A solution containing the amino compound [12] of 50 parts and polycarbonate resin [16] (in which the ratio of m:n is 1:1 and molecular weight is about 26,000) of 70 parts dissolved in tetrahydrofuran of 500 parts was applied onto the charge generating layer to form a charge transporting layer so that the thickness of dried layer would be 20 microns. Thus, a photosensitive member with two layers was prepared.

EXAMPLE 73

The charge generating layer was prepared in a manner similar to Example 45.

A solution containing the amino compound [16] of 50 parts and polycarbonate resin [12] (in which the ratio of m:n is 1:1 and molecular weight is about 36,000) of 70 parts dissolved in tetrahydrofuran of 500 parts was applied onto the charge generating layer to form a charge transporting layer so that the thickness of dried layer would be 20 microns. Thus, a photosensitive member with two layers was prepared.

EXAMPLE 74

The charge generating layer was prepared in a manner similar to Example 45.

A solution containing the amino compound [3] of 20 parts, the amino compound [12] of 20 parts and polycarbonate resin [4] (in which the ratio of m:n is 3:1 and molecular weight is about 35,000) of 70 parts dissolved in tetrahydrofuran of 500 parts was applied onto the charge generating layer to form a charge transporting layer so that the thickness of dried layer would be 20 microns. Thus, a photosensitive member with two layers was prepared.

EXAMPLE 75

The charge generating layer was prepared in a manner similar to Example 45.

A solution containing the amino compound [12] of 40 parts, polycarbonate resin [5] (in which the ratio of m:n is 1:1 and molecular weight is about 25,000) of 30 parts and polycarbonate resin [8] (in which the ratio of m:n is 4:1 and molecular weight is about 40,000) of 30 parts dissolved in dichloroethane of 500 parts was applied onto the charge generating layer to form a charge transporting layer so that the thickness of dried layer would be 20 microns. Thus, a photosensitive member with two layers was prepared.

Comparative Examples 10–13

Photosensitive members were prepared in a manner similar to Example 45 except that the above compound [e], the following compounds [o], [p] and [q] were used respectively instead of the amino compound [3].

[o]

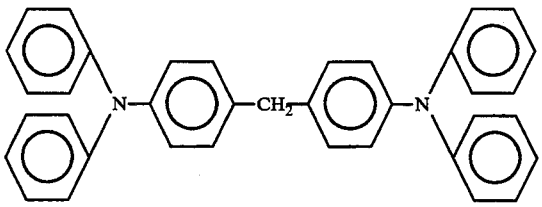

-continued

[p]

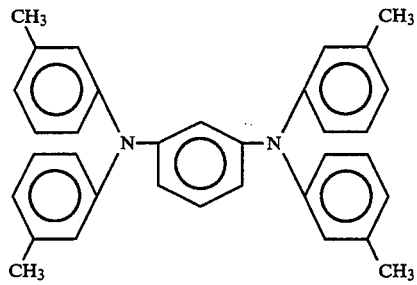

[q]

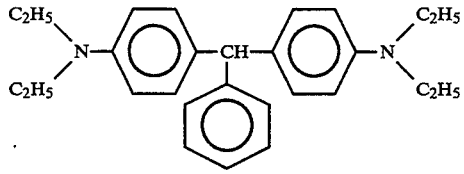

The resultant photosensitive members were installed in an copying machine (EP-470Z; made by Minolta Camera K.K.) and corona-charged by power of −6 KV level to evaluate initial surface potential $V_o$ (V), half-reducing amount ($E_{\frac{1}{2}}$ (lux.sec)) and dark decreasing ratio of the initial surface potential ($DDR_1$).

The results of $V_o$, $E_{\frac{1}{2}}$ and $DDR_1$ with respect to the photosensitive members were summarized in Table 6 below. Further, the photosensitive members obtained in Examples 45, 46 and 72 were installed in a copying machine (EP-5400; made by Minolta Camera K.K.) to be subjected to repetition test under negatively charged conditions. After 10,000 times of copy, $V_o$, $E_{\frac{1}{2}}$, $V_r$ (V) and worn amount (μm) were measured and photosensitive properties were evaluated totally. The results were summarized in Table 7.

TABLE 6

| | $V_0$ (V) | $E_{\frac{1}{2}}$ (lux · sec) | $DDR_1$ (%) |
|---|---|---|---|
| Example 45 | −660 | 1.1 | 2.6 |
| Example 46 | −660 | 1.2 | 2.5 |
| Example 47 | −650 | 0.9 | 3.0 |
| Example 48 | −660 | 0.9 | 2.4 |
| Example 49 | −650 | 0.8 | 2.8 |
| Example 50 | −650 | 0.8 | 2.9 |
| Example 51 | −660 | 0.7 | 2.6 |
| Example 52 | −650 | 0.8 | 3.0 |
| Example 53 | −650 | 0.9 | 3.1 |
| Example 54 | −660 | 0.8 | 2.6 |
| Example 55 | −650 | 1.0 | 2.8 |
| Example 56 | −650 | 1.1 | 2.9 |
| Example 57 | −660 | 1.0 | 2.5 |
| Example 58 | −660 | 0.8 | 2.4 |
| Example 59 | −660 | 0.8 | 2.6 |
| Example 60 | −650 | 0.8 | 2.9 |
| Example 61 | −650 | 0.7 | 3.1 |
| Example 62 | −650 | 0.7 | 3.0 |
| Example 63 | −660 | 0.7 | 2.4 |
| Example 64 | −650 | 0.8 | 2.9 |
| Example 65 | −660 | 1.1 | 2.6 |
| Example 66 | −650 | 1.4 | 2.8 |
| Example 67 | −650 | 0.9 | 2.7 |
| Example 68 | −660 | 1.3 | 2.6 |
| Example 69 | −650 | 1.2 | 2.9 |
| Example 70 | −660 | 0.9 | 2.4 |
| Example 71 | −660 | 0.8 | 2.3 |
| Example 72 | −650 | 0.8 | 2.5 |
| Example 73 | −650 | 0.7 | 2.8 |
| Example 74 | −650 | 0.8 | 2.9 |
| Example 75 | −650 | 0.8 | 2.7 |
| Comp. Example 10 | −650 | 1.5 | 2.9 |
| Comp. Example 11 | −660 | 2.7 | 2.4 |
| Comp. Example 12 | −650 | 1.8 | 3.2 |

TABLE 6-continued

| | $V_0$ (V) | $E_{\frac{1}{2}}$ (lux · sec) | $DDR_1$ (%) |
|---|---|---|---|
| Comp. Example 13 | −650 | 2.5 | 3.0 |

TABLE 7

| | initial stage | | | after 10000 time | | | image properties | worn amount |
|---|---|---|---|---|---|---|---|---|
| | $V_0$ | $E_{\frac{1}{2}}$ | Vr | $V_0$ | $E_{\frac{1}{2}}$ | Vr | | |
| Example 45 | −660 | 1.1 | 5 | −650 | 1.1 | 15 | exellent | 0.1 |
| Example 46 | −660 | 1.2 | 5 | −650 | 1.3 | 20 | exellent | 0.2 |
| Example 72 | −650 | 0.8 | 0 | −650 | 0.8 | 10 | exellent | 0.2 |

What is claimed is:

1. A photosensitive member having a photosensitive layer formed on an electrically conductive substrate and comprising an amino compound represented by the following general formula as a charge transporting material and an azo compound represented by the following general formula as a charge generating material;

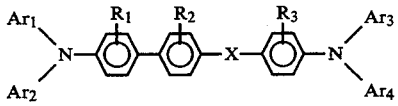

[A]

in which $Ar_1$, $Ar_2$, $Ar_3$, $Ar_4$ represent respectively an alkyl group, an aralkyl group, an aryl group, a biphenyl group or a heterocyclic group, each of which may have a substituent; $Ar_1$ and $Ar_2$, and/or $Ar_3$ and $Ar_4$ may form a ring in combination; $R_1$, $R_2$ and $R_3$ represent respectively a hydrogen atom, an alkyl group, an alkoxy group or a halogen atom; X represents —O—, —S—, —N($R_4$)— or —($R_5$)C($R_6$)— (in which $R_4$ represents an alkyl group, an aralkyl group, an aryl group, a biphenyl group or a heterocyclic group, each of which may have a substituent; $R_5$ and $R_6$ represent respectively a hydrogen atom, an alkyl group or an aryl group);

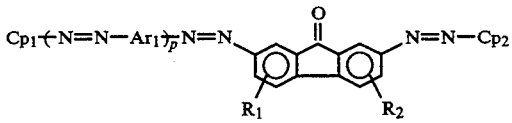

[a]

in which $R_1$ and $R_2$ represent respectively a hydrogen atom, a halogen atom, a nitro group, a hydroxy group, an alkyl group or an alkoxy group; $Ar_1$ represents an arylene group which may have a substituent; $Cp_1$ and $Cp_2$ represent respectively a residue of a coupler having a phenolic hydroxy group; p is 0 or 1.

2. A photosensitive member of claim 1, in which the photosensitive layer contains the charge generating material and the charge transporting material dispersed in a binder resin.

3. A photosensitive member of claim 2, in which the photosensitive layer has a thickness of 3 to 30 μm.

4. A photosensitive member of claim 1, in which the photosensitive layer comprises a charge generating layer and a charge transporting layer.

5. A photosensitive member of claim 4, in which the charge transporting layer has a thickness of 3 to 50 μm.

6. A photosensitive member having a photosensitive layer formed on an electrically conductive substrate and comprising an amino compound represented by the following general formula [A] as a charge transporting material and a polycarbonate resin having a number average molecular weight of from $1\times10^4$ to $1\times10^5$;

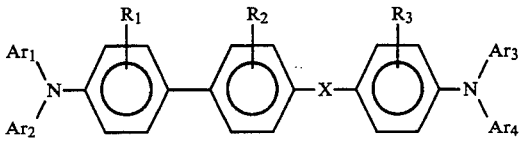

[A]

in which $Ar_1$, $Ar_2$, $Ar_3$, $Ar_4$ represent respectively an alkyl group, an aralkyl group, an aryl group, a biphenyl group or a heterocyclic group, each of which may have a substituent; $Ar_1$ and $Ar_2$, and/or $Ar_3$ and $Ar_4$ may form a ring in combination; $R_1$, $R_2$ and $R_3$ represent respectively a hydrogen atom, an alkyl group, an alkoxy group or a halogen atom; X represent —O—, —S—, —N($R_4$)— or —($R_5$)C($R_6$)— (in which $R_4$ represents an alkyl group, an aralkyl group, an aryl group, a biphenyl group or a heterocyclic group, each of which may have a substituent; $R_5$ and $R_6$ represent respectively a hydrogen atom, an alkyl group or an aryl group).

7. A photosensitive member having a photosensitive layer formed on an electrically conductive substrate and comprising an amino compound represented by the following general formula [A] as a charge transporting material and a charge generating material consisting of the group selected from a pyrrolopyrrole compound represented by the following general formula [B], a compound represented by the following general formula [C] and a compound represented by the following general formula [D];

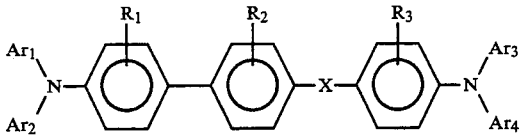

[A]

in which $Ar_1$, $Ar_2$, $Ar_3$, $Ar_4$ represent respectively an alkyl group, an aralkyl group, an aryl group, a biphenyl group or a heterocyclic group, each of which may have a substituent; $Ar_1$ and $Ar_2$, and/or $Ar_3$ and $Ar_4$ may form a ring in combination; $R_1$, $R_2$ and $R_3$ represent respectively a hydrogen atom, an alkyl group, an alkoxy group or a halogen atom; X represent —O—, —S—, —N($R_4$)— or —($R_5$)C($R_6$)— (in which $R_4$ represents an alkyl group, an aralkyl group, an aryl group, a biphenyl group or a heterocyclic group, each of which may have a substituent; $R_5$ and $R_6$ represent respectively a hydrogen atom, an alkyl group or an aryl group);

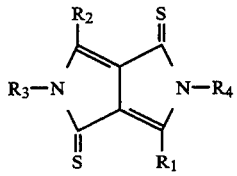

[B]

in which $R_1$ and $R_2$ represent respectively an alkyl group, an aralkyl group, a cycloalkyl group or an aryl group, each of which may have a substituent; $R_3$ and $R_4$ represent respectively a hydrogen atom, an alkyl group, an aralkyl group, an aryl group or a heterocyclic group;

[C]

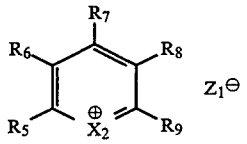

in which $R_5$, $R_6$, $R_7$, $R_8$ and $R_9$ represent respectively a hydrogen atom, an alkyl group, an alkoxy group or an aryl group which may have a substituent; $X_2$ represents an oxygen atom, a sulfur atom or a selenium atom; $Z_1$ represents an anionic functional group; $R_5$ and $R_6$ and/or $R_8$ and $R_9$ may form a ring in combination;

[D]

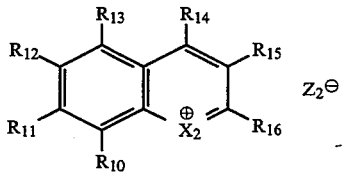

in which $R_{10}$, $R_{11}$, $R_{12}$ and $R_{13}$ represent respectively a hydrogen atom, a halogen atom, an alkoxy group, an alkyl group which may have a substituent or an aryl group which may have a substituent; $R_{14}$, $R_{15}$ and $R_{16}$ represent respectively a hydrogen atom, a halogen atom, a hydroxy group, an alkyl group which may have a substituent, a mercapto group which may have a substituent, a vinyl group which may have a substituent, an aryl group which may have a substituent, an alkenyl group which may have a substituent, a heterocyclic group which may have a substituent, an aroyl group which may have a substituent, an alkoxycarbonyl group which may have a substituent or —$NHR_{17}$; $R_{17}$ represents an alkyl group, a cycloalkyl group, an aralkyl group which may have a substituent or an aryl group which may have a substituent; $X_3$ represents an oxygen atom, a sulfur atom or a selenium atom; $Z_2$ represents an anionic functional group.

8. A photosensitive member having a photosensitive layer formed on an electrically conductive substrate and comprising an amino compound represented by the following general formula [A] as a charge transporting material and a polycarbonate resin represented by the following general formula [E];

[A]

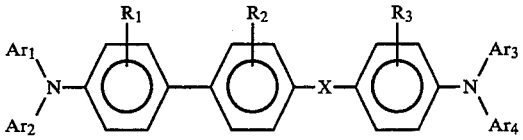

in which $Ar_1$, $Ar_2$, $Ar_3$, $Ar_4$ represent respectively an alkyl group, an aralkyl group, an aryl group, a biphenyl group or a heterocyclic group, each of which may have a substituent; $Ar_1$ and $Ar_2$, and/or $Ar_3$ and $Ar_4$ may form a ring in combination; $R_1$, $R_2$ and $R_3$ represent respectively a hydrogen atom, an alkyl group, an alkoxy group or a halogen atom; X represent —O—, —S—, —$N(R_4)$— or —$(R_5)C(R_6)$— (in which $R_4$ represents an alkyl group, an aralkyl group, an aryl group, a biphenyl group or a heterocyclic group, each of which may have a substituent; $R_5$ and $R_6$ represent respectively a hydrogen atom, an alkyl group or an aryl group);

[E]

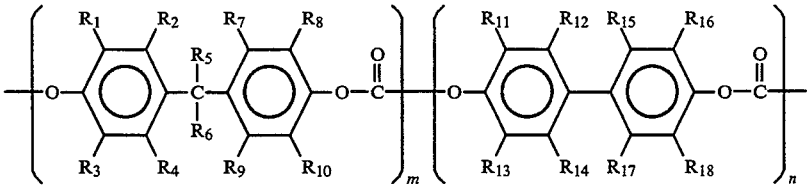

in which $R_1$, $R_2$, $R_3$, $R_4$, $R_7$, $R_8$, $R_9$ and $R_{10}$ represent respectively a hydrogen atom, an alkyl group, an aryl group or a halogen atom; $R_5$ and $R_6$ represent respectively a hydrogen atom, an alkyl group, a cycloalkyl group or an aryl group which may have a substituent; $R_5$ and $R_6$ may form a ring in combination; $R_{11}$, $R_{12}$, $R_{13}$, $R_{14}$, $R_{15}$, $R_{16}$, $R_{17}$ and $R_{18}$ represent respectively a hydrogen atom, an alkyl group, an aryl group or a halogen atom; m is an integer of 0–500; n is an integer of 5–100.

9. A photosensitive member of claim 8, in which the polycarbonate has a number average molecular weight of from $1\times10^4$ to $1\times10^5$.

* * * * *